US012703969B2

(12) United States Patent
Gessi

(10) Patent No.: US 12,703,969 B2
(45) Date of Patent: Aug. 11, 2026

(54) DISPLAY CABINET OF HYDROSANITARY DEVICES AND/OR ASSOCIATED PRODUCTS

(71) Applicant: GESSI S.P.A., Serraville Sesia (IT)

(72) Inventor: Gian Luca Gessi, Serravalle Sesia (IT)

(73) Assignee: GESSI S.P.A., Serravalle Sesia (IT)

( * ) Notice: Subject to any disclaimer, the term of this patent is extended or adjusted under 35 U.S.C. 154(b) by 30 days.

(21) Appl. No.: 18/656,320

(22) Filed: May 6, 2024

(65) Prior Publication Data

US 2025/0146258 A1 May 8, 2025

(30) Foreign Application Priority Data

Nov. 7, 2023 (IT) ..... 402023000003273
Apr. 11, 2024 (IT) ..... 202024000001600

(51) Int. Cl.
*E03C 1/18* (2006.01)
*E03D 7/00* (2006.01)
*E03D 9/00* (2006.01)

(52) U.S. Cl.
CPC ..... *E03C 1/18* (2013.01); *E03D 7/00* (2013.01); *E03D 9/00* (2013.01); *E03C 2201/90* (2013.01)

(58) Field of Classification Search
CPC ..... E03C 1/18; E03C 2201/90; E03D 7/00; E03D 9/00; A45C 2200/15; A45C 5/04;
(Continued)

(56) References Cited

U.S. PATENT DOCUMENTS 4,396,240 A * 8/1983 Henson ..... A47B 67/005 4/663
4,680,817 A * 7/1987 Sloan ..... A47K 4/00 4/312
(Continued)

FOREIGN PATENT DOCUMENTS

AT 002979 U1 8/1999
GB 2266735 A * 11/1993 ..... E04B 1/34869
(Continued)

OTHER PUBLICATIONS

Search Report in German Appln. No. 202024102340.4, mailed on Nov. 5, 2024, 9 pages (with English translation).

*Primary Examiner* — Lori L Baker
(74) *Attorney, Agent, or Firm* — Fish & Richardson P.C.

(57) ABSTRACT

Display cabinet of hydrosanitary devices and/or associated products configured to contain and keep a first hydrosanitary device and/or associated product in a first predefined position and/or spatial orientation and including a body having a first portion and a second portion reciprocally movable to define at least:

an opened configuration of said body, wherein said first hydrosanitary device and/or associated product results visible and/or accessible from outside the body, and a closed configuration of said body, alternative to the opened configuration, wherein said first hydrosanitary device and/or associated product results enclosed inside said body and/or not visible, and/or inaccessible, from outside the body;

said display cabinet being configured to be transportable along with said first hydrosanitary device and to be stably positionable on a resting surface in an exhibition environment;

(Continued)

said body being configured to simulate an application context of said first hydrosanitary device and/or associated product.

18 Claims, 7 Drawing Sheets

(58) Field of Classification Search
CPC ..... A45C 5/14; A47F 5/108; A47F 5/0823; A47F 7/00
USPC ..... 4/663
See application file for complete search history.

(56) References Cited

U.S. PATENT DOCUMENTS 4,868,936 A * 9/1989 Crocoli ..... B60R 15/00 4/663
5,438,713 A * 8/1995 Clarke ..... E03C 1/01 4/663
6,185,759 B1 * 2/2001 Staudenmayer ..... A47K 17/026 4/663
6,405,388 B1 * 6/2002 Brown ..... A47K 4/00 4/612
6,820,290 B1 * 11/2004 Mullick ..... E03C 1/324 4/663
7,137,156 B2 * 11/2006 Yang ..... E04H 1/1216 4/476
7,549,606 B2 * 6/2009 Quan ..... B64D 11/02 4/663
7,984,520 B2 * 7/2011 Hall ..... A47K 11/026 4/663
8,347,428 B2 * 1/2013 Hawkins ..... G09B 25/00 4/321
2008/0042530 A1 2/2008 Hawkins
2012/0223035 A1 * 9/2012 Kelley, III ..... A47B 19/002 211/74
2013/0232685 A1 * 9/2013 Cornille ..... A47K 4/00 4/663
2015/0013063 A1 * 1/2015 Boodaghians ..... H01M 8/00 4/663

FOREIGN PATENT DOCUMENTS

WO WO-9207152 A1 * 4/1992 ..... E04H 3/02
WO WO-2005004691 A1 * 1/2005 ..... E04H 1/1216
WO WO-2005120901 A1 * 12/2005 ..... B60R 15/00

* cited by examiner

FIG.9
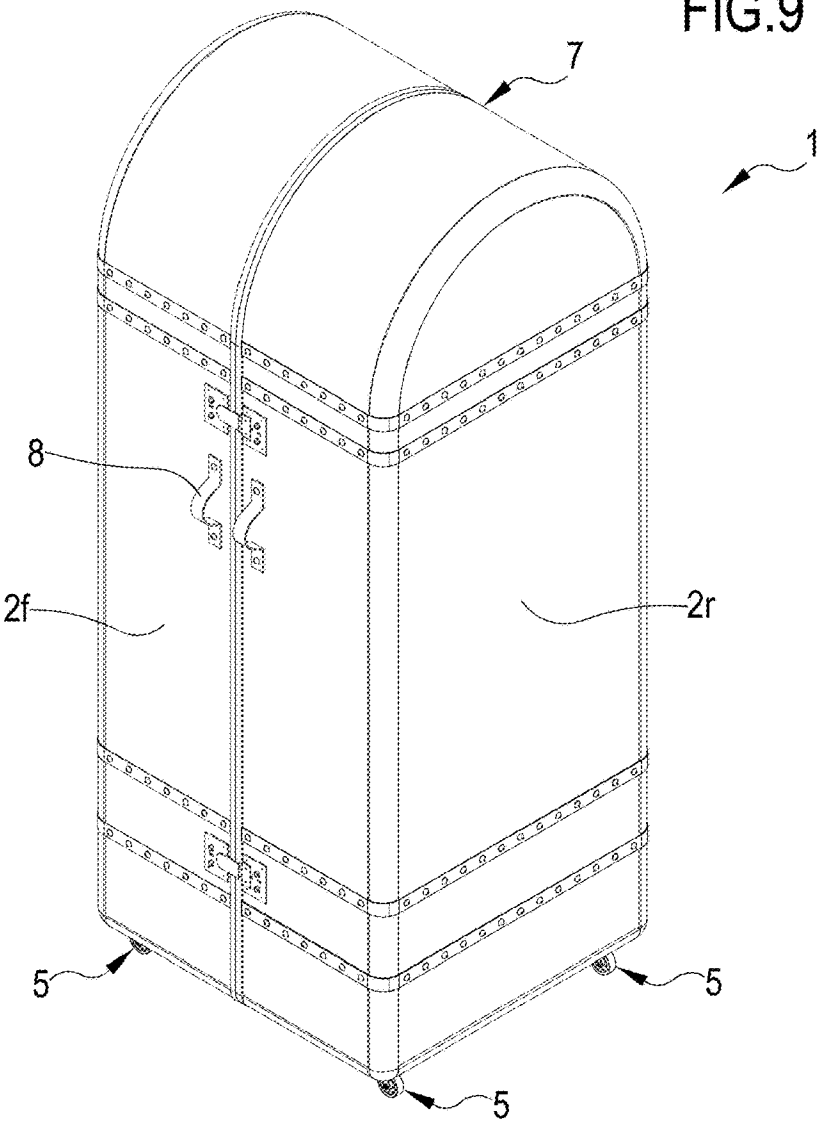
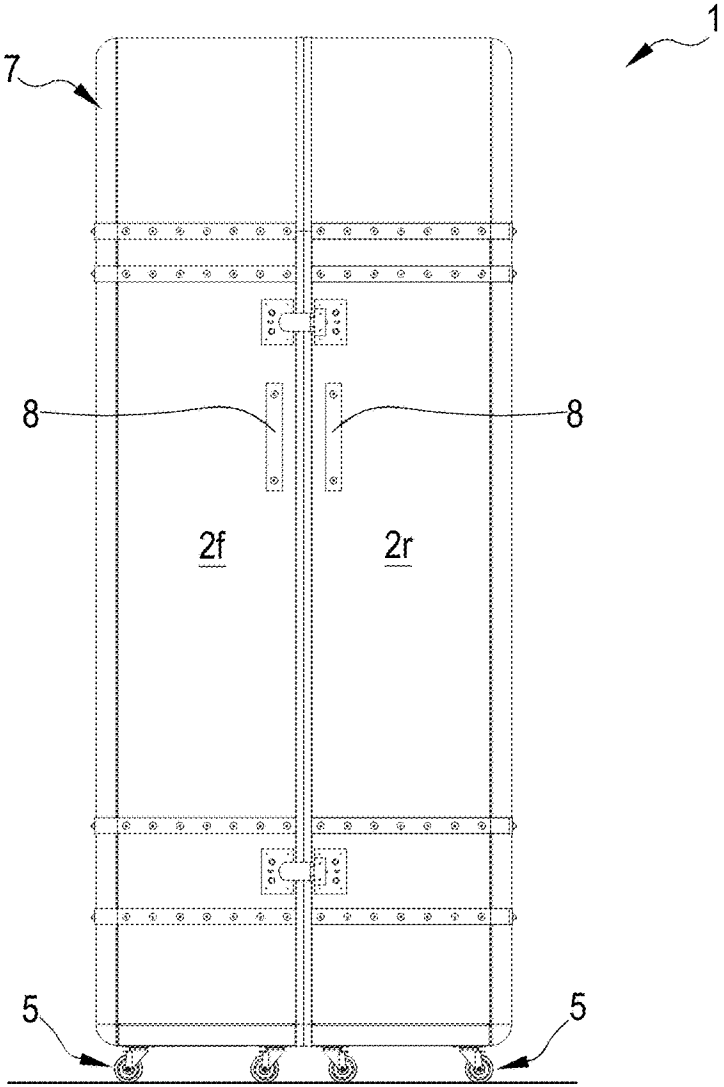
FIG.8

FIG.10
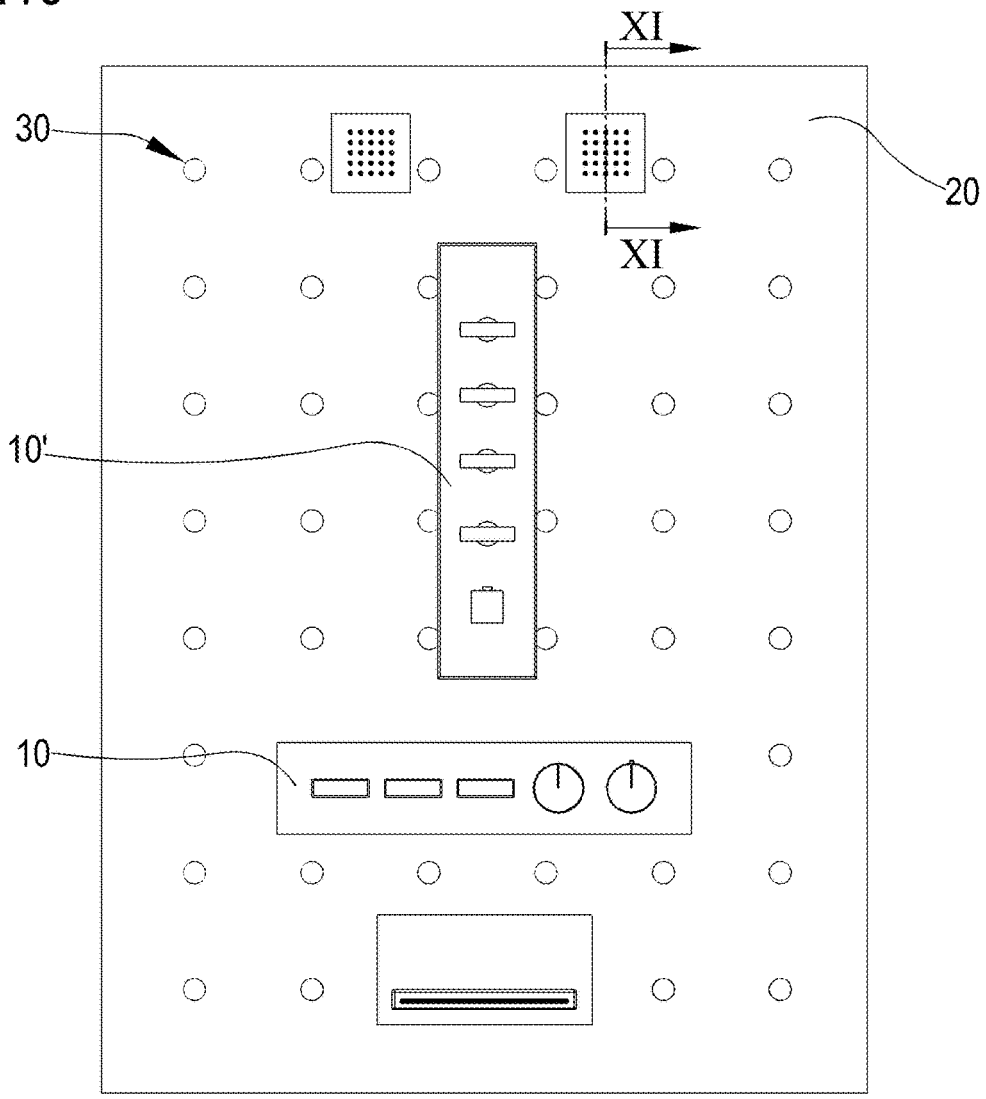
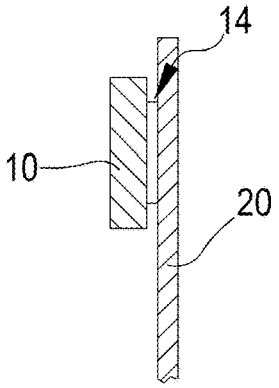
FIG.11
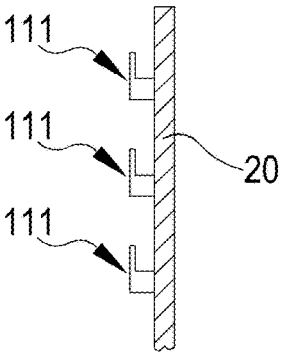
FIG.12

FIG.13
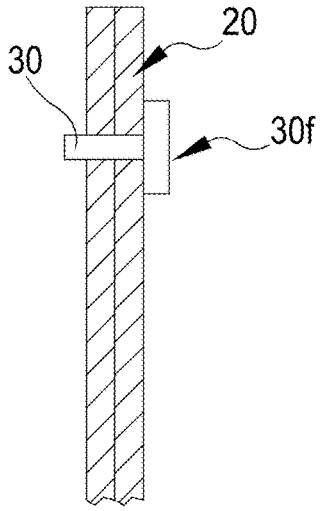
FIG.14
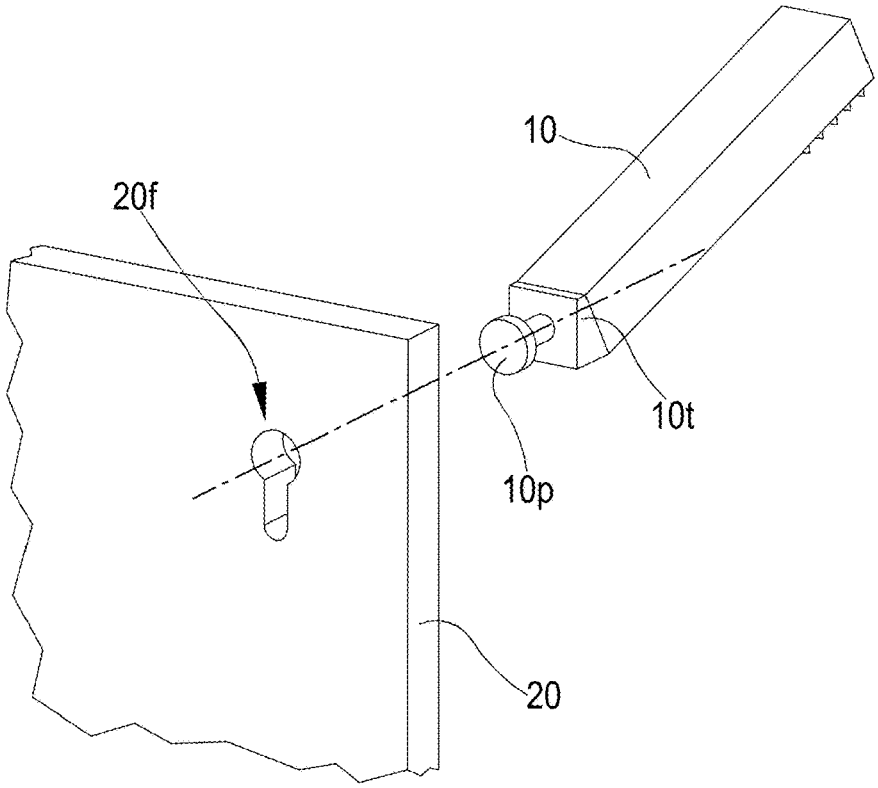
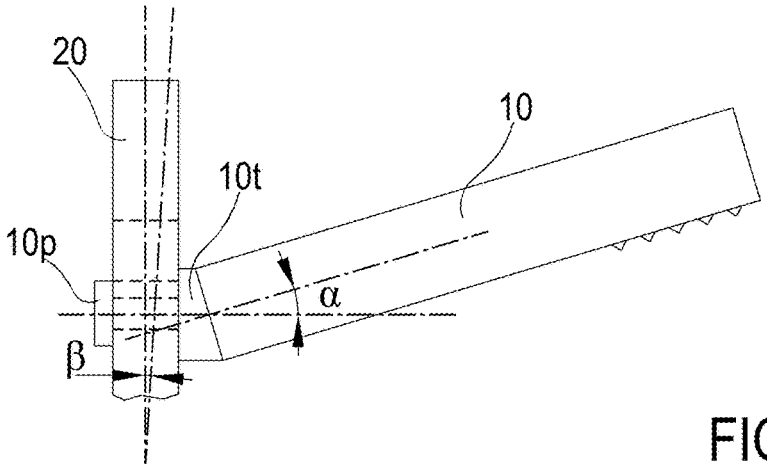
FIG.15

DISPLAY CABINET OF HYDROSANITARY DEVICES AND/OR ASSOCIATED PRODUCTS

CROSS-REFERENCE TO RELATED APPLICATIONS

This application claims the benefit of priority under 35 U.S.C. § 119 (a) to Italian Utility Model application No. 202024000001600, filed on Apr. 11, 2024, and Italian Design application Ser. No. 402023000003273, filed Nov. 7, 2023. The disclosure of each of the foregoing applications is incorporated herein by reference.

FIELD OF THE ART

The present disclosure refers to the field of display cabinets, and in particular concerns a display cabinet of hydrosanitary devices.

BACKGROUND

The hydrosanitary devices have been the subject of intense design activity, aimed at turning them from mere objects provided with a technical function to objects that—while keeping the main technical function—are characterized by remarkable aesthetic pleasantness.

The hydrosanitary devices are therefore nowadays produced in various shapes and designs, and are often combined according to design lines, where each design line combines hydrosanitary devices under a common design concept.

Therefore, the hydrosanitary devices have become the subject of exhibitions not only at manufacturers or retailers, but also at dedicated trade shows or even fairs dedicated to design.

SUMMARY

The Applicant has noted that there is the need to transport even large quantities of hydrosanitary devices and that, in order to make the public aware of what is the effective aesthetic appearance that the hydrosanitary devices have when inserted and combined between them in their environmental context, it is necessary that they are displayed in a context of accessory elements that simulates at least part of the effective environmental context in which they will be inserted.

For this reason, the Applicant has conceived a display cabinet of hydrosanitary devices, the main aspects of which are provided below.

The aspects herein described can be combined with each other, or with portions of the detailed description or claims.

According to the present disclosure is described a display cabinet of hydrosanitary devices and/or associated products (1) configured to contain and keep at least one first hydrosanitary device (10) and/or associated product in at least one first predefined position and/or spatial orientation and comprising a body (2) having at least one first portion (2*f*) and one second portion (2*r*) reciprocally movable to define at least:

- an opened configuration of said body (2), wherein said at least one first hydrosanitary device (10) and/or associated product results visible and/or accessible from outside the body (2), and
- a closed configuration of said body (2), alternative to the opened configuration, wherein said at least one first hydrosanitary device (10) and/or associated product results enclosed inside of said body (2) and/or not visible, and/or inaccessible, from outside the body (2);

said display cabinet of hydrosanitary devices and/or associated products (1) being configured to be transportable along with said at least one first hydrosanitary device (10) and/or associated product and to be stably positionable on a resting surface (100) in an exhibition environment.

According to a further non-limiting aspect, the display cabinet of hydrosanitary devices and/or associated products (1), is configured to contain and keep at least one first hydrosanitary device (10) and/or associated product, in at least one first predefined position and/or spatial orientation on, or with respect to, at least one supporting surface positioned within said body (2), optionally in at least one between said first portion (2*f*) and said second portion (2*r*).

According to a further non-limiting aspect, said body (2) is configured to allow to simulate an application context of said at least one first hydrosanitary device (10) and/or associated product.

According to a further non-limiting aspect, said body (2), preferably at least one between said first portion (2*f*) and said second portion (2*r*), is substantially rigid and/or self-supporting.

According to a further non-limiting aspect, said display cabinet of hydrosanitary devices and/or associated products (1) is a movable display cabinet and is conceived and specifically configured to be operatively moved in a plurality of positions.

According to a further non-limiting aspect, said display cabinet of hydrosanitary devices and/or associated products (1) is conceived and specifically configured to be operatively moved in a plurality of positions both when in said opened configuration and when in said closed configuration.

According to a further non-limiting aspect, said display cabinet of hydrosanitary devices and/or associated products (1) is conceived and specifically configured to be operatively moved in a plurality of positions at least when said body (2) is in said opened configuration and/or when said body (2) is in said closed configuration.

According to a further non-limiting aspect, each position of said plurality of positions is a position stable on said resting surface (100).

According to a further non-limiting aspect, at least one between said first portion (2*f*) and said second portion (2*r*) is configured to house said at least one first hydrosanitary device (10) and/or associated product in said at least one first predefined position and/or spatial orientation.

According to a further non-limiting aspect, at least one between said first portion (2*f*) and said second portion (2*r*) is specifically configured to house said at least one first hydrosanitary device (10) and/or associated product in said at least one first predefined position and/or spatial orientation and in at least one second predefined position and/or spatial orientation.

According to a further non-limiting aspect, said first predefined position and/or spatial orientation and/or said second predefined position and/or spatial orientation is a position and/or spatial orientation relative with respect to said body (2) or to at least one between said first portion (2*f*) and said second portion (2*r*).

According to a further non-limiting aspect, when in said first predefined position and/or spatial orientation and when in said second predefined position and/or spatial orientation said at least one first hydrosanitary device (10) and/or associated product lies in a position fixed with respect to at least part of the body (2), in particular with respect to at least one between the first portion (2*f*) and the second portion (2*r*)

and/or wherein said first predefined position and/or spatial orientation is kept unaltered during a movement of at least one between said first portion (2*f*) and said second portion (2*r*) with respect to said resting surface (100).

According to a further non-limiting aspect, a passage from said first predefined position and/or spatial orientation to said second predefined position and/or spatial orientation occurs by means of a temporary disconnection of said at least one first hydrosanitary device (10) from said body (2), in particular from said first portion (2*f*) and said second portion (2*r*).

According to a further non-limiting aspect, at least one between said first portion (2*f*) and said second portion (2*r*) is configured to house, simultaneously, said at least one first hydrosanitary device (10) and/or associated product and one second hydrosanitary device (10').

According to a further non-limiting aspect, an upper part (7) of said body (2), in particular an upper part (7) of the first portion (2*f*) and of the second portion (2*r*) assumes a substantially curved and/or rounded shape, suitable for defining an overall "trunk" shape for said body.

According to a further non-limiting aspect, an upper part (7) of said body (2), in particular an upper part of the first portion (2*f*) and of the second portion (2*r*) is squared and/or presents an at least partially planar, preferably substantially planar surface; said surface being optionally at least partially parallel to said resting surface (100).

According to a further non-limiting aspect, at least one between said first portion (2*f*) and said second portion (2*r*) comprises a movement handle (8), preferably arranged on a substantially vertical surface of said first portion (2*f*) and/or of said second portion (2*r*).

According to a further non-limiting aspect, said body (2) is configured to assume a plurality of opened configurations.

According to a further non-limiting aspect, in each opened configuration of said plurality of opened configurations, said first portion (2*f*) and said second portion (2*r*) assume different angles of reciprocal rotation.

According to a further non-limiting aspect, in at least part of said plurality of opened configurations, optionally in all of the opened configurations of said plurality of opened configurations, said at least one first hydrosanitary device (10) and/or associated product results visible and/or accessible, preferably visible and/or accessible from outside said body (2).

According to a further non-limiting aspect, when said body (2) is in said closed configuration, the first portion (2*f*) and the second portion (2*r*) are rigidly and reciprocally constrained.

According to a further non-limiting aspect, when said body (2) is in said opened configuration, said first portion (2*f*) and said second portion (2*r*) are reciprocally connected.

According to a further non-limiting aspect, said at least one first hydrosanitary device (10) and/or associated product is arranged in, and/or fixed, optionally directly, to, said first portion (2*f*) or alternatively to said second portion (2*r*), in particular leaving the second portion (2*r*) free to move with respect to the first portion (2*f*) without removal of the arrangement, and/or of the fastening, optionally direct, of the at least one first hydrosanitary device (10) and/or associated product from the respective first portion (2*f*) or second portion (2*r*).

According to a further non-limiting aspect, when said body (2) is in said closed configuration, said first portion (2*f*) is a front portion or left portion and said second portion (2*r*) is a rear portion or right portion.

According to a further non-limiting aspect, when said body (2) is in said opened configuration, said first portion (2*f*) is a left portion and said second portion (2*r*) is a right portion.

According to a further non-limiting aspect, said first portion (2*f*) and said second portion (2*r*) are reciprocally rotating.

According to a further non-limiting aspect, said first portion (2*f*) and said second portion (2*r*) are reciprocally rotating on an axis substantially orthogonal to said resting surface (100).

According to a further non-limiting aspect, said display cabinet of hydrosanitary devices and/or associated products (1) comprises at least one first hinge (3) configured to allow a rotation of said first portion (2*f*) with respect to said second portion (2*r*) around an axis substantially inclined with respect to said resting surface (100) of said display cabinet of hydrosanitary devices and/or associated products (1).

According to a further non-limiting aspect, said resting surface (100) is a floor, preferably substantially planar, or ground and/or said display cabinet of hydrosanitary devices and/or associated products (1) is a floor display cabinet.

According to a further non-limiting aspect, each of said first portion (2*f*) and said second portion (2*r*) comprises a respective peripheral and/or perimeter area.

According to a further non-limiting aspect, said at least one first hinge (3) is arranged in correspondence of the peripheral and/or perimeter area of at least one between said first portion (2*f*) and said second portion (2*r*).

According to a further non-limiting aspect, when said body (2) is in said opened configuration, said first portion (2*f*) and said second portion (2*r*) are substantially aligned along a same plane (K).

According to a further non-limiting aspect, said at least one between said first portion (2*f*) and said second portion (2*r*), optionally both said first portion (2*f*) and said second portion (2*r*), comprises a plurality of compartments or modules (4).

According to a further non-limiting aspect, a position of at least one compartment or module of said plurality of compartments or modules (4) is reconfigurable in a space inside said body (2).

According to a further non-limiting aspect, said compartments or modules (4) are suitable for housing one or more hydrothermal sanitary devices (10) and/or associated products.

According to a further non-limiting aspect, said compartments or modules (4) comprise supporting planes, walls substantially oblique with respect to the resting surface (100), drawers or internal doors.

According to a further non-limiting aspect, a position of at least one compartment or module of said plurality of compartments or modules (4) is spatially re-configurable in the respective position assumed in a space inside said body (2) into the volume overall defined in said body (2), by the first portion (2*f*) and/or by the second portion (2*r*).

According to a further non-limiting aspect, at least one between said first portion (2*f*) and said second portion (2*r*), preferably both the first portion (2*f*) and the second portion (2*r*), has a main development direction substantially vertical and/or orthogonal with respect to said resting surface (100).

According to a further non-limiting aspect, said display cabinet of hydrosanitary devices and/or associated products (1) is configured and specifically destined to support and/or arrange, preferably when arranged on said resting surface (100), said at least one first hydrosanitary device (10) and/or associated product at a height, measured with respect to said resting surface (100), substantially equal to a height at which said at least one first hydrosanitary device (10) and/or associated product would be arranged in an effective and/or own operative installation.

According to a further non-limiting aspect, at least one between said first portion (2*f*) and said second portion (2*r*) defines an environment substantially closed on at least three sides, preferably on at least three substantially orthogonal sides, optionally substantially closed on five sides, preferably on five substantially orthogonal sides.

According to a further non-limiting aspect, said first portion (2*f*) and said second portion (2*r*) define an environment opened on a respective accessing plane.

According to a further non-limiting aspect, when the body is in said closed configuration, said accessing plane of said first portion (2*f*) is coupled and substantially coinciding with the accessing plane of said second portion (2*r*) and the assembly formed by the first portion (2*f*) and by the second portion (2*r*) defines as a whole an environment closed on six substantially orthogonal sides.

According to a further non-limiting aspect, at least one between said first portion (2*f*) and said second portion (2*r*) comprises a wall, preferably a rear wall, configured to be decorable with or providable with, or decorated with or provided with, an element comprising a color, a color pattern and/or shapes and/or an accessory, and/or an electronic device for representation of time-varying images, suitable for and/or specifically destined to simulate a real environment wherein said at least one first hydrosanitary device (10) and/or associated product would be installed in a real configuration.

According to a further non-limiting aspect, said element and/or said electronic device is positioned in correspondence of an external surface of said wall.

According to a further non-limiting aspect, said external surface of said wall faces the outside of said body (2).

According to a further non-limiting aspect said wall comprises an internal surface and an external surface, opposed with respect to said internal surface, and said external surface is configured to house in a removable way said element and/or said electronic device.

According to a further non-limiting aspect, said wall is visible when said body (2) is in said opened configuration.

According to a further non-limiting aspect, at least one between said first portion (2*f*) and said second portion (2*r*) comprises at least one first movement element (5), in use in direct contact with the resting surface (100) and constrained, preferably movably constrained, to a lower portion, in particular a base portion, of said at least one between said first portion (2*f*) and said second portion (2*r*).

According to a further non-limiting aspect, the at least one first movement element (5) is configured to facilitate at least one between a rotation or translation of said body (2), in particular of at least one between said first portion (2*f*) and said second portion (2*r*), on said resting surface (100).

According to a further non-limiting aspect, at least one between said first portion (2*f*) and said second portion (2*r*), optionally each of said first portion (2*f*) and said second portion (2*r*), comprises at least two movement elements, and preferably comprises at least three or four movement elements (5) configured and arranged to stably sustain, and/or to allow the motion of, each of said first portion (2*f*) and second portion (2*r*).

According to a further non-limiting aspect, said at least one first movement element (5) comprises at least one between a wheel, a roller, a track, a movable belt, a low friction coefficient sliding skid.

According to a further non-limiting aspect, said at least one first movement element (5) is substantially pivoting around an axis substantially inclined with respect to said resting surface (100).

According to a further non-limiting aspect, said at least one first movement element (5) is active and is configured to determine a movement of said body (2) on said resting surface (100).

According to a further non-limiting aspect, said display cabinet of hydrosanitary devices and/or associated products (1) comprises at least one movement servo-actuator for said at least one first movement element (5).

According to a further non-limiting aspect, said display cabinet of hydrosanitary devices and/or associated products (1) comprises at least one user interface placed in substantial correspondence of said body (2).

According to a further non-limiting aspect, said user interface is configured to control said movement servo-actuator.

According to a further non-limiting aspect, said display cabinet of hydrosanitary devices and/or associated products (1) comprises a remote-control interface configured to allow a control of said movement servo-actuator by means of a remote-control device, preferably remotely positioned with respect to said body (2).

According to a further non-limiting aspect, the display cabinet of hydrosanitary devices and/or associated products (1) comprises at least one optical radiator element (6) configured to irradiate said at least one first hydrosanitary device (10) and/or associated product with an optical radiation preferably and at least partially lying in the visible spectrum.

According to a further non-limiting aspect, said at least one optical radiator element (6) is configured to be remotely controlled, optionally by a remote controller, preferably of wireless type, and/or by a virtual assistant.

According to a further non-limiting aspect, said at least one optical radiator element (6) is configured to diffuse an optical radiation within a solid angle of preferential radiation, said solid angle being preferably operatively adaptable.

According to a further non-limiting aspect, said display cabinet of hydrosanitary devices and/or associated products (1) comprises at least one power supply source for said at least one optical radiator element (6) and arranged within said body (2) and/or comprises at least one connector to allow to supply said optical radiator element (6) by means of a power supply source external with respect to said body (2).

According to a further non-limiting aspect, said at least one first hydrosanitary device (10) and/or associated product is a faucet, optionally a faucet for sink, or for bidet, or for bathtub or for shower, or an electronic faucet, or a mechanically, not electronically, regulated faucet, or is a showerhead, or is a flexible shower, or is a aerator dispenser, or is a wall spout mouth, or is a toilet bowl, or is a bidet, or is a shower tray, or is a bathtub, or is a kitchen or bathroom sink, or is a hanging sink, or is a floor sink, or is a built-in sink, or is a heated towel rack, or is a toilet paper holder, or is a toilet bowl brush holder, or is a soap holder, or is a sponge holder, or is a bathrobe, or a towel, or a bath slipper, or a bath cap, or a bath mat.

According to a further non-limiting aspect, said at least one first hydrosanitary device (10) and/or associated product is realized at least partially in ceramic or ceramic-like material, and/or in stone and/or in metallic material and/or wood.

According to a further non-limiting aspect, said hydrosanitary device (10) and/or associated product is a device destined to the hygiene of the human being.

According to a further non-limiting aspect, the display cabinet of hydrosanitary devices and/or associated products (1) comprises at least one servo-actuator configured to facilitate or determine a relative movement between said first portion (2*f*) and said second portion (2*r*) and/or to allow a switching between said opened configuration and said closed configuration of said body (2).

According to a further non-limiting aspect, said servo-actuator is controlled by a command arranged substantially on said body (2) or removably connectable to said body (2) and/or is controlled by a remote command.

According to a further non-limiting aspect, said remote command is of wireless type.

According to a further non-limiting aspect, the display cabinet of hydrosanitary devices (1) and/or associated products comprises at least one speaker for playing back sounds, optionally arranged within said body (2), preferably within at least one between said first portion (2*f*) and said second portion (2*r*).

According to a further non-limiting aspect, at least one between said first portion (2*f*) and said second portion (2*r*) detects a substantially defined shape and/or a substantially defined volume; or wherein at least one between said first portion (2*f*) and said second portion (2*r*) comprises movable elements, optionally extensible, configured to modify at least one between a volume and/or external shape thereof between a first volume and/or external shape and a second volume and/or external shape.

According to a further non-limiting aspect, at least one between said first portion (2*f*) and said second portion (2*r*) comprises at least one supporting surface for said at least one first hydrosanitary device (10) and/or associated product.

According to a further non-limiting aspect, said at least one supporting surface is movable for allowing to orient or translate said at least one first hydrosanitary device (10) and/or associated product in a plurality of positions.

According to a further non-limiting aspect, said supporting surface is manually movable or by means of a servo-actuator.

According to the present disclosure is also described a display cabinet of hydrosanitary devices and/or associated products (1), configured to contain and keep at least one first hydrosanitary device (10) and/or associated product, in at least one first predefined position and/or spatial orientation and comprising a body (2) having at least one first portion (2*f*) and a second portion (2*r*) reciprocally movable to define at least:

- an opened configuration of said body (2), wherein said at least one hydrosanitary device (10) and/or associated product results visible and/or accessible from outside the body (2), and
- a closed configuration of said body (2), alternative to the opened configuration, wherein said at least one first hydrosanitary device (10) and/or associated product results enclosed inside of said body (2) and visible, and optionally inaccessible, from outside the body (2);

said display cabinet of hydrosanitary devices and/or associated products (1) being configured to be transportable along with said at least one first hydrosanitary device (10) and/or associated product and to be stably positionable on a resting surface (100) in an exhibition environment;

wherein said opened configuration is a non-operative configuration and/or an installation and/or removal configuration of said at least one first device (10) and/or associated product respectively within or from said body (2).

According to a further non-limiting aspect, when said body (2) is in said closed configuration, said at least one first hydrosanitary device (10) and/or associated product results inaccessible from outside the body (2).

According to a further non-limiting aspect, when said body (2) is in said opened configuration, said first portion (2*f*) and said second portion (2*r*) are disconnected.

According to a further non-limiting aspect, said opened configuration is a configuration wherein said body (2) is disassembled.

According to a further non-limiting aspect, the display cabinet of hydrosanitary devices and/or associated products (1) is configured to allow a user to configure and repeatedly re-configure for a plurality of times, the position of the hydrosanitary device (10) and/or associated product with respect to said supporting surface of the body (2).

According to the present disclosure is also here described the use of the display cabinet of hydrosanitary devices and/or associated products (1), for containing, transporting and/or exhibiting in an exhibition environment, hydrosanitary devices and/or associated products (1).

According to the present disclosure is further described a method for containing, transporting and/or exhibiting hydrosanitary devices and/or associated products (1) comprising at least the steps of:

- arranging a display cabinet according to one or more of the aspects herein described;
- housing and/or fixing at least one first hydrosanitary device (10) and/or associated product, in at least one first predefined position and/or spatial orientation inside the body (2) of said display cabinet; and
- exhibiting at least said first hydrosanitary device (10) and/or associated product, housed in said body (2) of said displaying device, in an exhibition environment.

According to a further non-limiting aspect, the method further comprises at least one of the following steps:

- closing at least said first hydrosanitary device (10) and/or associated product into said body (2) by means of a relative motion of closure of said first portion (2*f*) with respect to said second portion (2*r*);
- transporting, towards or into an exhibition environment, said display device containing said first hydrosanitary device (10) and/or associated product; and/or
- opening said body (2) containing at least said first hydrosanitary device (10) and/or associated product, by means of a relative motion of aperture of said first portion (2*f*) with respect to said second portion (2*r*).

FIGURES

The following detailed description concerns some non-limiting embodiments of display cabinet, described with reference to the attached figures.

FIG. 8 shows a front view of the display cabinet of hydrosanitary devices object of the present disclosure, in a closed configuration.

FIG. 9 shows a perspective view of the display cabinet of hydrosanitary devices object of the present disclosure, in a closed configuration.

FIG. 10 shows a front view of a supporting surface of the body of the display cabinet object of the present disclosure, where it is present a plurality of hydrosanitary devices.

FIG. 11 shows a first embodiment of retention means between the supporting surface and the hydrosanitary device.

FIG. 12 shows a second embodiment of retention means between the supporting surface and the hydrosanitary device.

FIG. 13 shows a sectional view of a particular embodiment of a supporting surface.

FIG. 14 and FIG. 15 show respectively a perspective and sectional view of a particular connection between the supporting surface and the hydrosanitary device.

DETAILED DESCRIPTION

Figure 1:
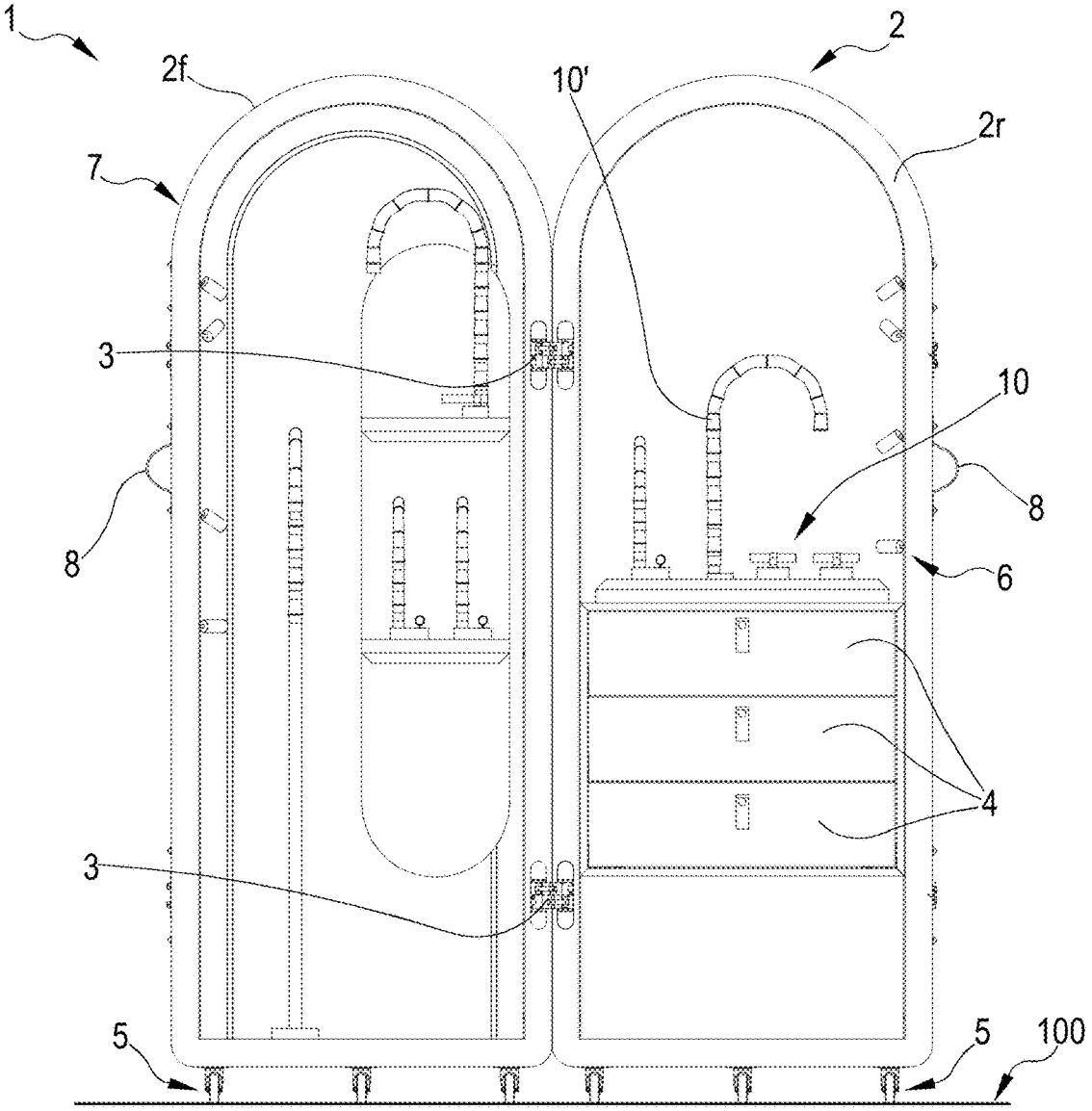
FIG. 1 shows a front view of the display cabinet of hydrosanitary devices object of the present disclosure, in an opened configuration.

The present disclosure refers to a display cabinet of hydrosanitary devices and/or associated products 1. The display cabinet of hydrosanitary devices and/or associated products 1 is configured to be transportable along with the plurality of hydrosanitary devices, and to provide the user with a simulation of an environment wherein the hydrosanitary devices would actually be placed. Then, the display cabinet of hydrosanitary devices and/or associated products 1 is configured to allow to simulate an application context of at least one hydrosanitary device 10.

In particular, in a specific embodiment, the display cabinet of hydrosanitary devices and/or associated products 1 is configured to be transported with at least one hydrosanitary device 10 and/or associated product, preferably a plurality of hydrosanitary devices 10 and/or associated products, already installed, preferably in a fixed though removable way, in a display configuration.

For this purpose, the display cabinet herein described comprises at least one supporting surface which may conveniently be positioned in the first portion 2*f* and/or in the second portion 2*r* of the body 2 better described below.

The display cabinet of hydrosanitary devices and/or associated products 1 object of the present disclosure clearly allows a user to configure and re-configure, for one or more times, the position of the hydrosanitary device 10 and/or associated product with respect to the supporting surface of the body 2.

The display cabinet is configured to contain and keep at least one first hydrosanitary device 10 and/or associated product, in at least one first predefined position and/or spatial orientation on, or with respect to, at least to said supporting surface positioned within said body 2.

As it will become clear from the description provided below, the display cabinet of hydrosanitary devices and/or associated products 1 object of the present disclosure can assume at least one first closed configuration and a second opened configuration. Figures from 1 to 7 show a plurality of views of the display cabinet of hydrosanitary devices and/or associated products 1 in opened configuration, while FIGS. 8 and 9 show the display cabinet of hydrosanitary devices and/or associated products 1 in closed configuration.

Clearly, the closed configuration is a configuration alternative to the opened configuration.

Non-limiting examples of hydrosanitary devices and/or associated products comprise:

- a faucet, optionally a faucet for sink, or for bidet, or for bathtub or for shower;
- an electronic faucet, provided with an electronic control interface suitable for allowing at least one between the regulation of the at least instantaneous flow rate of the faucet and/or of the temperature of the fluid that in use flows toward the outlet of the faucet;
- a mechanically, not electronically, regulated faucet, suitable for allowing at least one between the regulation of the at least instantaneous flow rate of the faucet and/or of the temperature of the fluid that in use flows toward the outlet of the faucet;
- a showerhead,
- a flexible shower, with rubberized and/or metallic tube, and/or with plastic portions;
- a aerator dispenser, optionally of adjustable type;
- a wall spout mouth, capable of providing a single water delivery pattern or a plurality of water delivery patterns alternatively selectable or selectable in combination;
- a toilet bowl, in particular a suspended toilet bowl or a floor-standing toilet bowl;
- a bidet, in particular a suspended bidet or a floor-standing bidet;
- a kitchen or bathroom sink, or a hanging sink, or a floor sink, or a built-in sink,
- a shower tray,
- a bathtub,
- a heated towel rack, for example electrically heated and/or heated by means of hot fluid supply (water, air, oil),
- a toilet paper holder,
- a toilet bowl brush holder,
- a soap holder,
- a sponge holder,
- a bathrobe, or a towel,
- a bath slipper,
- a bath cap,
- a bath mat.

The shower tray, the bathtub, the toilet bowl, the bidet and the sink constitute non-limiting examples of devices generally pertaining to the field of hydrosanitary devices typically realized in ceramic or ceramic-like material or in stone or material similar to stone or in wood.

The display cabinet of hydrosanitary devices and/or associated products 1 is configured to contain a plurality of hydrosanitary devices each one in at least one first predefined position and/or spatial orientation; however, some non-limiting embodiments of the display cabinet of hydrosanitary devices and/or associated products 1 can be destined to contain a single hydrosanitary device.

The display cabinet here described may be destined to house hydrosanitary devices also of big size and/or arranged at a height substantially equal to the eyes of a user. For this reason, it can reach a height of 100 cm, or 120 cm, or 150 cm, or 180 cm, or 200 cm.

The display cabinet of hydrosanitary devices and/or associated products 1 comprises a body 2, that defines a first portion 2*f* and a second portion 2*r*. The body 2, in particular at least one between the first portion 2*f* and the second portion 2*r* and more preferably both the first and the second portion, is/are rigid and/or self-supporting. In particular, in a non-limiting embodiment, the perimetral walls of the first portion 2*f* and/or of the second portion 2*r* are self-supporting.

The attached figures show a specific embodiment of the display cabinet of hydrosanitary devices and/or associated products 1 wherein the first portion 2*f* and the second portion 2*r* present same size and detect as a whole a same internal volume. However, this feature is not to be intended as limiting.

Thus, in an embodiment that should not be intended as limiting, the first portion 2*f* and the second portion 2*r* of the body 2 are substantially, at least externally, identical.

An embodiment of the display cabinet of hydrosanitary devices and/or associated products 1 is characterized in that at least one between the first portion 2*f* and the second portion 2*r* is provided with, and/or defines a, volume and/or volume profile and/or variable shape.

In particular, at least one between the first portion 2*f* and the second portion 2*r* can be at least partially of the substantially folding type, and/or have panels, or movable planes that can be extended outward, varying and in particular increasing—when extended—the overall surface or volumetry of the involved portion.

In some non-limiting embodiments, this functionality is offered only when the body 2 is in opened configuration.

Otherwise, where the above-described technical function is not present, the external surface substantially rigid of the body 2 and in particular of the first portion 2*f* and/or of the second portion 2*r* defines a substantially defined volume and/or shape.

In the embodiment of the attached figures, an upper part 7 of the body 2, in particular an upper part of the first portion 2*f* and of the second portion 2*r*, is of substantially curved shape, in particular rounded with a convexity facing outward. This upper part 7 concurs to define an overall "trunk" structure for said body 2. Clearly this conformation is not to be intended in a limiting way.

In fact, a non-limiting embodiment comprises an upper part of the body 2 of substantially squared and/or at least partially planar shape; a specific embodiment presents a surface substantially planar (in particular, entirely planar), this surface is preferably parallel to the resting surface 100.

The first portion 2*f* and the second portion 2*r* are reciprocally movable, in order to be able to realize the above-mentioned closed configuration and opened configuration.

The assembly formed by the first portion 2*f* and by the second portion 2*r*, when in closed configuration, detects a section in substantially square or rectangular plant. This geometric figure of the plant section should not be intended in a limiting way. In fact, this plant section can be characterized by a number of sides less or greater than four, and/or at least one of the lateral walls of the first portion 2*f* and of the second portion 2*r* can assume a curved shape.

At least one handle 8, present on the first portion 2*f* or on the second portion 2*r* or, alternatively, on both the first portion 2*f* and the second portion 2*r* is provided in an accessible portion, preferably a substantially vertical portion of the first portion 2*f* and of the second portion 2*r* to allow a smooth relative movement between the above-mentioned portions.

The handles 8 can be in a number greater than one for each portion. The handles 8 can be substantially of identical size and/or shape, or differ in size and/or shape.

The above-described handles can be combined or replaced by a servomechanism that is installed in such a way as to serve as an aid to the relative movement between the first portion 2*f* and the second portion 2*r*. The servomechanism can be used for switching from the closed configuration to the opened configuration and vice versa.

The handles herein described can be foldable or closeable or be alternatively substantially rigid.

The servomechanism preferably comprises at least one between an electric motor and a hydraulic actuator, for example, a hydraulic linear actuator.

Closing hooks or equivalent elements for removable locking can be arranged in correspondence of the first portion 2*f* and of the second portion 2*r* in order to ensure the permanence of the closed configuration for the body 2; the presence of closing hooks or equivalent elements for removable locking (that in particular realize a removable block), facilitates and makes the movement of the display cabinet safer during the transport in closed configuration, since it prevents unintended openings of the body 2. The closing hooks or the equivalent elements for removable locking help to realize a configuration wherein the first and the second portion 2*f*, 2*r* realize a substantially rigid assembly as a cover and protection of the plurality of hydrosanitary devices 10 and/or associated products during the transport.

The servomechanism, where present, can free or stop these elements for removable locking.

The servomechanism can be activated by a command arranged on the body of the display cabinet object of the present disclosure or be remotely controllable.

The attached figures show a specific embodiment wherein is present a first handle and a second handle; the first handle is arranged on the first portion 2*f* while the second handle is arranged on the second portion 2*r*.

In the closed configuration, the first portion 2*f* and the second portion 2*r* are rigidly and reciprocally constrained.

In the opened configuration, the plurality of hydrosanitary devices 10 and/or associated products results visible and/or accessible, and in particular can result enclosed inside the body 2.

Movable supporting surfaces can be present in order to allow the movement of the at least one first hydrosanitary device 10 and/or associated product inside the volume detected by the first portion 2*f* and/or of the second portion 2*r*.

These movable supporting surfaces can be movable by hand or by means of a servoactuation system preferably active or activable when the body 2 is in opened configuration.

In a specific embodiment, when in the opened configuration, the plurality of hydrosanitary devices 10 and/or associated products does not protrude from the volume defined by the first portion 2*f* or from the volume defined by the second portion 2*r*. In a further embodiment, the plurality of hydrosanitary devices 10 and/or associated products does not protrude and is completely enclosed within the body 2 as a whole, but when the body 2 is in the opened configuration, at least part of the plurality of hydrosanitary devices 10 and/or associated products protrudes for example from the volume defined by the first portion 2*f* or from the volume defined by the second portion 2*r*. It is then clear that a specific and non-limiting embodiment is such that the second portion 2*r* defines a second internal volume of the body 2 as a complement to the first internal volume of the body defined by the first portion 2*f*.

Therefore, it appears clear that the display cabinet of hydrosanitary devices 1 is destined to keep the plurality of hydrosanitary devices 10 and/or associated products in a predefined position and/or spatial orientation both during the transport, i.e., when the body 2 is in closed configuration and during the exhibition, i.e., when the body 2 is in opened configuration.

Preferably, the relative position assumed by at least one between the first portion 2*f* and the second portion 2*r* of the body 2 with respect to the plurality of hydrosanitary devices 10 and/or associated products is not altered during the transport.

The predefined position and/or spatial orientation is a position or spatial orientation relative with respect to the body 2. Since the display cabinet of hydrosanitary devices and/or associated products 1 is movable with respect to the resting surface 100, it is clear that should the position and/or spatial orientation be defined with respect to the resting surface 100, with the movement of the display cabinet also the position and/or spatial orientation would vary.

Considering the body 2 in closed configuration, the predefined position and/or spatial orientation is fixed with respect to the body 2 in its entirety, i.e., fixed with respect to the assembly formed by the first portion 2*f* and second portion 2*r*. This is due to the fact that in the closed configuration the second portion 2*r* is preferably rigidly constrained to the first portion 2*f*.

In the opened configuration, because of the relative mobility existing between the first portion 2*f* and the second portion 2*r*, the predefined position and/or spatial orientation is fixed with respect to the first portion 2*f* or to the second portion 2*r*, depending on whether the hydrosanitary device 10 and/or associated products is installed in the first portion 2*f* or is installed in the second portion 2*r*.

Each hydrosanitary device 10 and/or associated product is installed either on the first portion 2*f* or on the second portion 2*r*. This ensures an effective and flexible movement possibility between the above-mentioned portions.

The accessible configuration is a configuration wherein the user can touch or grasp the hydrosanitary devices 10 and/or associated products. In particular, the accessible configuration is a configuration wherein the user can touch or grasp the hydrosanitary devices 10 and/or associated products by a front portion of the display cabinet.

In the closed configuration, the plurality of hydrosanitary devices 10 and/or associated products results not visible, and/or inaccessible, from outside the body 2.

A specific embodiment can be provided with a first portion 2*f* and with a second portion 2*r* whose perimeter walls are substantially opaque, and therefore do not allow to see the hydrosanitary devices present inside the display cabinet.

A further embodiment can have at least one between the first portion 2*f* and the second portion 2*r* that are provided with at least one respective portion of lateral wall substantially transparent, in such a way to allow to see the devices present inside the display cabinet even when the latter is in closed configuration.

The inaccessible configuration is a configuration wherein the user cannot touch or grasp the hydrosanitary devices 10 and/or associated products. In particular, the inaccessible configuration is a configuration wherein the user cannot touch or grasp the hydrosanitary devices 10 and/or associated products accessing from a front portion of the display cabinet.

In order to make the exhibition experience as real as possible, in a non-limiting embodiment the display cabinet of hydrosanitary devices and/or associated products 1 is configured to, and specifically destined to, allow to contain at least one functioning hydrosanitary device 10 and/or associated product. This means that the hydrosanitary device 10 and/or associated product, if necessary, can be moved at operative parts thereof and/or connected to a power source (e.g., water source, power supply source) and be made effectively functioning.

Connectors for the connection of the at least one first hydrosanitary device 10 and/or associated product can possibly be provided on the body 2 and realize intermediate connection elements that allow to connect the device and the power supply source to the hydrosanitary device 10 and/or associated product by means of the intermediate connection of the power supply source on the connector itself.

It thus appears clear that the display cabinet of hydrosanitary devices 1 object of the present disclosure is also destined to keep the plurality of hydrosanitary devices 10 and/or associated products in at least one specific position and/or spatial orientation, differentiating itself from those temporary containers from which, when the hydrosanitary device 10 and/or associated product is appropriately exhibited, this hydrosanitary device 10 and/or associated product is removed.

In a preferred embodiment, the display cabinet of hydrosanitary devices and/or associated products 1 is configured to be arranged, and/or positioned (in particular also repositioned) on a resting surface 100, such as and not limiting thereto a floor or a street level. The display cabinet herein described can be considered a floor display cabinet. Preferably, the resting surface 100 is a substantially planar surface.

The display cabinet of hydrosanitary devices and/or associated products 1 is configured to be stably positionable on the resting surface 100; the stable position realizes a position that, although also operatively alterable by a user, allows the user to be able to observe, touch or grasp the hydrosanitary devices 10 and/or associated products in a stable way with respect to the floor. The term "stably" should not be intended as indicating an unalterable position but excludes unstable positioning solutions such as suspension without contact, direct or indirect, of a bottom portion of the display cabinet with the resting surface 100.

The display cabinet of hydrosanitary devices and/or associated products 1 is a movable display cabinet, i.e., a display cabinet conceived and specifically configured to be movable in a plurality of positions without the need of intervention by specialized people, i.e., is movable in a plurality of positions when in operative configuration.

Each position of said plurality of positions is a position stable on the resting surface 100.

The operative configuration is the above-mentioned closed configuration or is the above-mentioned opened configuration.

In particular the display cabinet of hydrosanitary devices and/or associated products 1 is conceived and specifically configured to be operatively moved in a plurality of positions both when in said opened configuration and when in said closed configuration. Thanks to this technical feature the display cabinet object of the present disclosure is of particular and flexible use.

Figure 7:
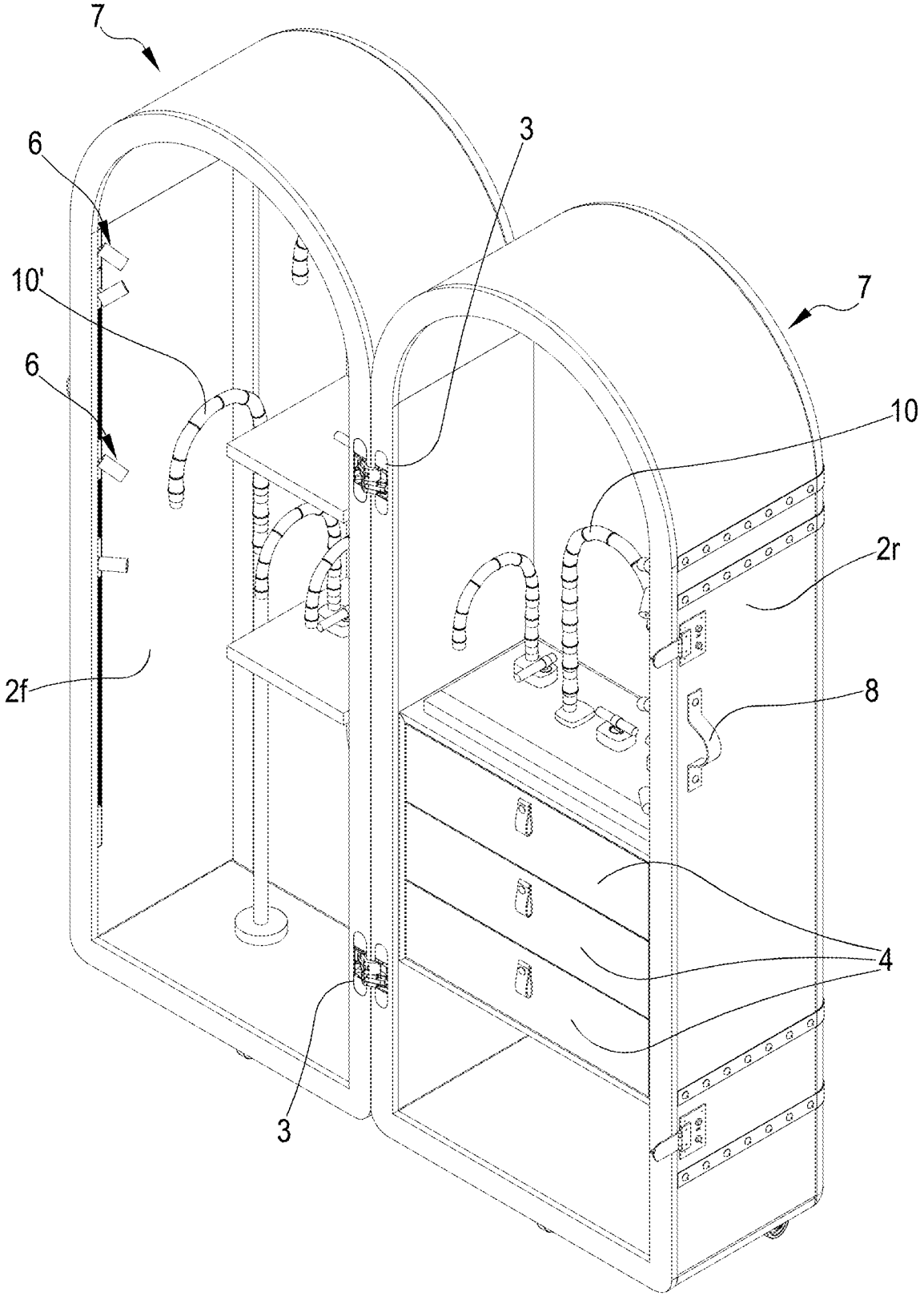
FIG. 7 shows a perspective view of the display cabinet of hydrosanitary devices.

In FIG. 1 and in FIG. 7 is represented and visible a particular embodiment of the display cabinet of hydrosanitary devices and/or associated products 1 wherein the hydrosanitary devices 10, 10' and/or associated products are positioned both in the first portion 2*f* and in the second portion 2*r*. However, in order to ensure the movement freedom of the first portion 2*f* with respect to the second portion 2*r* without the need to release the hydrosanitary devices 10, 10' and/or associated products from their respective (preferably direct) fastening to the first portion 2*f* and second portion 2*r*, these hydrosanitary devices 10, 10' and/or associated products are alternatively fixed either to the first portion or to the second portion. Therefore, there is no fastening, although removable, between a single hydrosanitary device and both the first and the second portion.

This is not to be intended as mandatory: there are in fact embodiments wherein hydrosanitary devices 10, 10' and/or associated products are positionable only in the first portion 2*f* or only in the second portion 2*r*.

The display cabinet of hydrosanitary devices 1 object of the present disclosure is specifically configured to allow to reposition the hydrosanitary devices 10 and/or associated products in a plurality of positions or spatial orientations within the volume overall defined by the body 2, and in particular by the first portion 2*f* and/or by the second portion 2*r*. Thanks to this technical feature, the display cabinet herein described is particularly flexible in allowing to realize various simulations of environmental configuration for the hydrosanitary devices 10 and/or associated products.

Each position or spatial orientation between the plurality of positions or spatial orientations is operatively fixed; this means that to reposition the hydrosanitary devices 10 and/or associated products between the first and a second position or spatial orientation is necessary to act by means of a disconnection or disassembly of the same hydrosanitary devices 10 with respect to one or more surfaces of the first portion 2*f* or of the second portion 2*r*. This technical feature means that during the step of movement of the first portion 2*f* or of the second portion 2*r* is possible to keep unaltered the position or spatial orientation relatively present between the hydrosanitary devices 10 and/or associated products and the body 2, in particular between the hydrosanitary devices 10 and/or associated products and the first portion 2*f* and/or the second portion 2*r*.

As it appears clear at least from FIG. 1 and from FIG. 7, a preferred embodiment of the display cabinet for hydrosanitary devices 1 and/or associated products object of the present disclosure is configured to house simultaneously a plurality of hydrosanitary devices 10 and/or associated products, in particular when of small sizes such as for example faucets.

More in particular, at least one between the first portion 2*f* and the second portion 2*r* and preferably both the first and the second portion 2*f*, 2*r* are specifically configured to house simultaneously two hydrosanitary devices 10 and/or associated products.

The display cabinet of hydrosanitary devices and/or associated products 1 object of the present disclosure shown in the attached figures comprises two hinges 3; these two hinges 3 allow a rotation of the first portion 2*f* with respect to the second portion 2*r*. Although it is shown in the attached figures a technical solution wherein the hinges are two, this number should not be intended as limiting. The hinge could be one only; however, a high number of hinges gives greater overall stability to the assembly formed by the first portion 2*f* with respect to the second portion 2*r*.

Each of said first portion 2*f* and of said second portion 2*r* comprises a respective peripheral and/or perimeter area; the two hinges 3 are arranged in correspondence of the peripheral and/or perimeter area of at least one between said first portion 2*f* and said second portion 2*r*; in particular, the side on which are arranged the two hinges 3 is a substantially vertical side, i.e., a side aligned on a substantially vertical plane.

The hinges allow to keep the first portion 2*f* and the second portion 2*r* reciprocally connected when the body 2 is in opened configuration. The Applicant has conceived embodiments wherein—even in the absence of the above-mentioned hinges—the first portion 2*f* and the second portion 2*r* are connected when the body 2 is in opened configuration. However, the first portion 2*f* and the second portion 2*r* could be reciprocally disconnected when the body 2 is in opened configuration.

Figure 2:
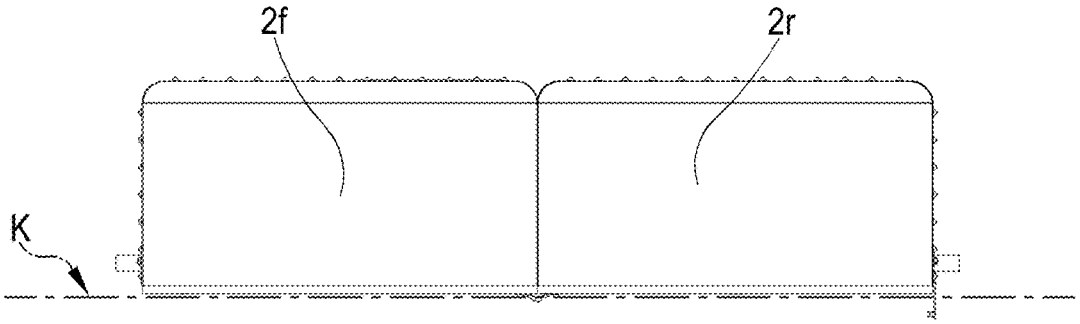
FIG. 2 shows a view from above of the display cabinet of hydrosanitary devices, in an opened configuration.
Figure 3:
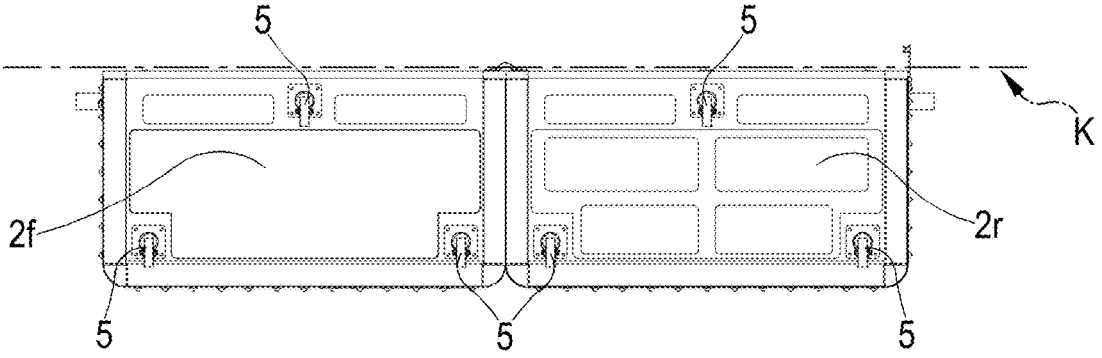
FIG. 3 shows a view from below of the display cabinet of hydrosanitary devices.
Figure 4:
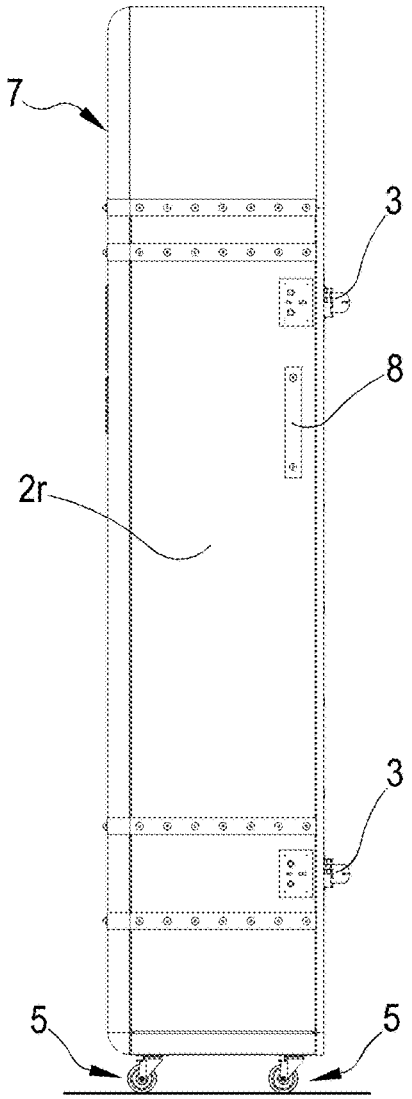
FIG. 4 shows a first lateral view of the display cabinet of hydrosanitary devices.
Figure 5:
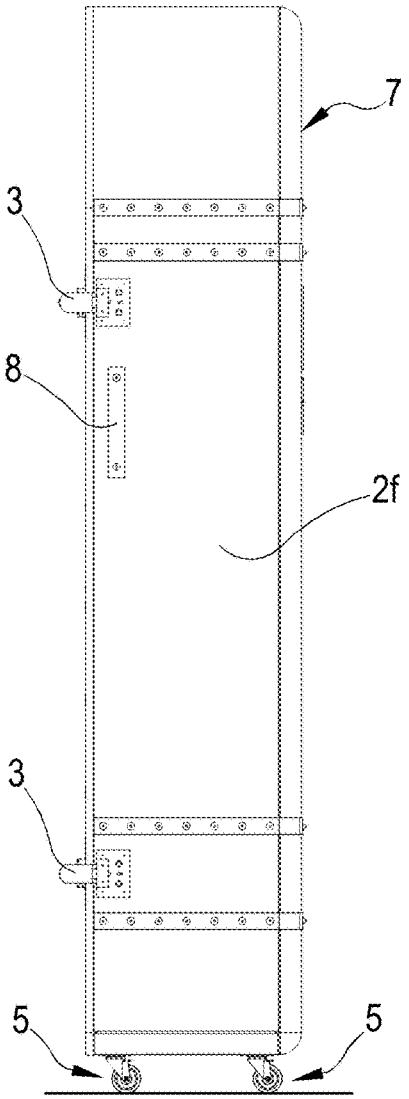
FIG. 5 shows a second lateral view of the display cabinet of hydrosanitary devices.
Figure 6:
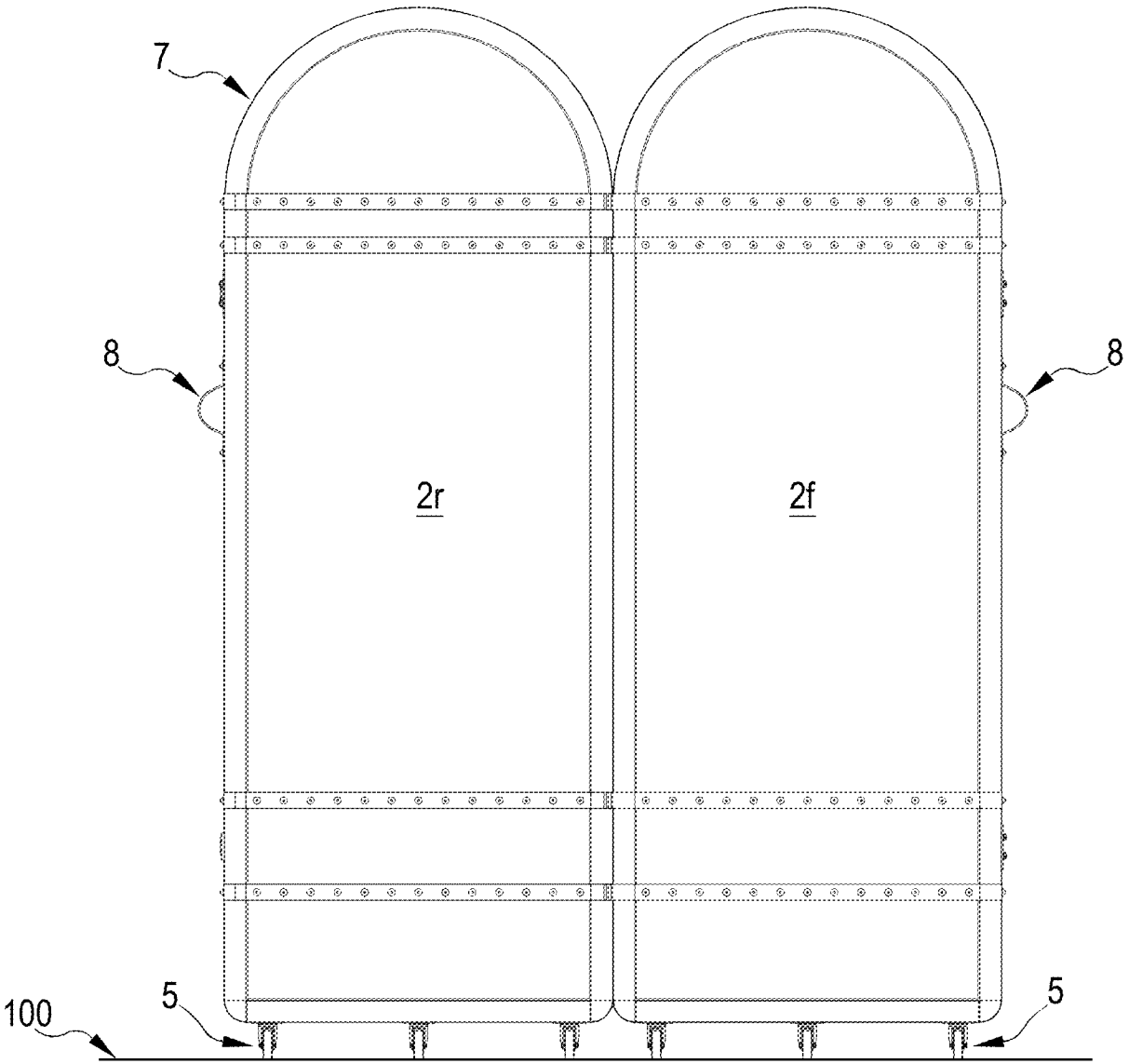
FIG. 6 shows a rear view of the display cabinet of hydrosanitary devices.

As it appears clear at least from FIG. 2 and from FIG. 3, in a peculiar embodiment, when said body 2 is in opened configuration, said first portion 2*f* and said second portion 2*r* are substantially aligned along a same plane K.

It is noted that the particular configuration of the hinges 3 is such that the display cabinet of hydrosanitary devices 1 object of the present disclosure can assume a plurality of opened configurations, wherein at least part of said plurality of opened configurations, and in particular all of the opened configurations, can be capable of making the hydrosanitary device 10 and/or associated products, or if present the plurality of hydrosanitary devices 10 and/or associated products, visible and/or accessible as previously above described.

The plurality of opened configurations differs because of a different angle of rotation of the first portion 2*f* with respect to said second portion 2*r*.

In particular, in a non-limiting embodiment, the hinges allow to move in rotation the first portion 2*f* with respect to the second portion 2*r* seamlessly.

Although specific hinge solutions can be adopted, generally a hinge can be provided with two supporting plates, connected between them by means of a pin or an axis. One of the plates is fixed on the first portion 2*f* and the other is fixed on the second portion 2*r*. The movement of the hinge occurs thanks to the rotation of the axis or pin. When the first portion 2*f* is opened or closed with respect to the second portion 2*r*, the hinge allows it to rotate around its pin, allowing thus the opening or the closing without effort and with fluidity.

In a non-limiting embodiment, the hinges 3 can be hidden hinges, i.e., hidden inside the body 2 when the first portion 2*f* and the second portion 2*r* are closed.

Preferably the hinges 3 can be realized in metal, galvanized or stainless steel, or brass.

As it is clearly represented in the attached figures, preferably but non-limiting thereto, when the body 2 is in said closed configuration, the first portion 2*f* is a front portion or left portion and the second portion 2*r* is a rear portion or right portion.

When the body 2 is in opened configuration (FIGS. 1-7), the first portion 2*f* is a left portion and the second portion 2*r* is a right portion.

The embodiment represented in the attached figures is such that the first and second portions can reciprocally rotate around an axis of rotation that is substantially vertical, i.e., substantially orthogonal with respect to the resting surface 100. The axis of the first hinge preferably coincides with the axis of the second hinge.

In FIG. 1 and in FIG. 7 is clearly represented an embodiment of the display cabinet of hydrosanitary devices and/or associated products 1 wherein it is present a plurality of compartments or modules 4 detected by supporting shelves, walls substantially oblique with respect to the resting surface 100, drawers, interior doors, which can be spatially reconfigurable in their position assumed within the volume overall detected by the first portion 2*f* and/or by the second portion 2*r*.

It is noted, in particular, that the drawers can detect elements suitable for allowing to store one or more hydrosanitary devices 10 and/or associated products, which are positioned on the supporting shelves when the display cabinet has been positioned in the position of interest.

It is noted also that the embodiment of the display cabinet of hydrosanitary devices 1 represented in the attached figures presents a main development direction substantially vertical, or orthogonal with respect to the resting surface 100.

In a non-limiting embodiment, a height overall achieved by the display cabinet of hydrosanitary devices and/or associated products 1 is at least equal to 170 cm or 180 cm or 190 cm. This can allow to appropriately position the hydrosanitary devices 10 and/or associated products also at heights significantly high with respect to the ground, also helping to effectively simulate what would be the real environment in which determined types of hydrosanitary devices 10 and/or associated product are positioned. Consider towel warmers, which are typically provided with significant extension in vertical and which are typically arranged at a height equal to or even greater than that of the face of a user of average height.

In particular, thus, in an embodiment the display cabinet of hydrosanitary devices 1, in particular when it is appropriately arranged on the resting surface 100, is configured and specifically destined to support and/or arrange at least one first hydrosanitary device 10 and/or associated product at a height, measured with respect to said resting surface 100, substantially equal to a height at which the first hydrosanitary device 10 and/or associated product would be arranged in an effective and/or own operative installation.

Although this technical feature should not be considered limiting, preferably the first portion 2*f* and the second portion 2*r* define, each, an environment substantially closed on at least three sides, preferably on at least three substantially orthogonal sides. Even more preferably the first and the second portion 2*f*, 2*r* define each one an environment closed on five sides and comprise: a floor (lower surface), a left side, a right side opposed with respect to the left side, a rear side, preferably substantially orthogonal with respect to the left side and to the right side, and a head wall that in the embodiment of the attached figures is characterized by the concavity facing outward that gives to the head wall itself an arched shape. The sides opposed to the front or rear side of each one between the first and the second portion 2*f*, 2*r* are visible in FIGS. 4 and 5.

The inner face of the rear side, i.e., the face of the rear side that is visible in operative configuration when the body 2 is in opened configuration to show the user the hydrosanitary devices 10 and/or associated products herein contained, can be decorated with colors, patterns, furniture elements such as and non-limiting thereto mirrors or glasses, in order to contribute to an effective simulation of a real environment.

It appears thus clear that the first and the second portion 2*f*, 2*r* define each one an open environment on a respective accessing plane. When the body 2 is in closed configuration, the accessing plane of the first portion 2*f* is coupled and substantially coinciding with the accessing plane of the second portion 2*r*; this technical feature is clearly highlighted in FIGS. 8 and 9.

The internal face of the rear side, or of one of the left and/or right or upper or lower side can be provided with a ledwall or an equivalent electronic device of time-varying image production.

Other embodiments conceived by the Applicant are such that a wall of the body 2, in particular of at least one between the first portion 2*f* and the second portion 2*r*, are provided with an external face (opposed to the internal face, the latter facing the internal volume) that is configured to house removably the ledwall or equivalent electronic device and/or the element marked by the above-mentioned colors and/or pattern. For this purpose, temporary fastening elements such as hooks and/or Velcro and/or magnetic elements can be provided. The ledwall or equivalent electronic device is remotely controllable and/or by means of a virtual assistant, and in particular a virtual assistant controllable by means of vocal commands.

Furthermore, some embodiments of the display cabinet herein described can be provided with speakers for playing back sounds, in particular at least when the display cabinet is in opened configuration. Preferably the speakers are arranged inside the volume overall detected by said first portion 2*f* and said second portion 2*r*.

When the body 2 is in closed configuration, the assembly formed by the first portion 2*f* and by the second portion 2*r* defines as a whole an environment closed on six sides, substantially orthogonal.

As schematically represented for example in FIG. 1 or in FIG. 3, at least one between the first portion 2*f* and the second portion 2*r*, preferably both the first portion 2*f* and the second portion 2*r*, comprises (comprise) at least one movement element 5.

The purpose of the movement element 5 is to facilitate at least one between a rotation or a translation of the body 2, in particular of at least one between the first portion 2*f* and the second portion 2*r*, on the resting surface 100.

Preferably, at least one between the first portion 2*f* and the second portion 2*r* comprises at least one first movement element 5 and a second movement element 5. This technical solution gives greater stability to the first portion 2*f* and to the second portion 2*r* and is useful in particular when these portions are of large size or must withstand high forces.

In FIG. 3 is clearly represented an embodiment wherein the first portion 2*f* and the second portion 2*r* both comprise three movement elements 5. Thanks to this technical feature is it is given special stability to the assembly formed by the first portion 2*f* and by the second portion 2*r* without hyperstaticity feature.

The three movement elements 5 are preferably arranged in a triangle-like configuration, or in any other spatial configuration that allows to make the first portion 2*f* and the second portion 2*r* stable, also separately, when laid on the resting surface 100.

The three movement elements 5, connected to the base wall of each of the first portion 2*f* or of the second portion 2*r*, are for example two in front position and one in rear position or vice versa.

The movement elements 5 are constrained, in particular movably constrained, on the bottom wall of the first portion 2*f* and of the second portion 2*r*.

In the preferred embodiment of the display cabinet of hydrosanitary devices 1 object of the present disclosure, the movement elements 5 are pivoting wheels around a vertical axis, or anyway substantially inclined with respect to the resting surface 100.

Alternatively, or in combination, at least part of the movement elements 5, that in use come into direct contact with the resting surface 100, can comprise a wheel, a roller, a track, a movable belt, a low friction coefficient sliding skid.

Preferably, in particular where the total weight of the assembly formed by the display cabinet and by the hydrosanitary devices 10 herein contained is relevant, the movement elements 5 can be lockable. In particular, the wheels can be locked by a respective brake, arranged in correspondence of each wheel. The brake has at least one stable braking operative configuration of the wheel and one stable non-braking operative configuration.

It is noted that the technical feature of having pivoting wheels around a sensibly vertical axis facilitates in combination both the relative movement of the first portion 2*f* with respect to the second portion 2*r* during the movement in rotation that causes the switching from the closed configuration to the opened configuration and vice versa, and the movement in rototranslation of the entire assembly formed by the first portion 2*f* and by the second portion 2*r* when the body 2 is—and remains—in closed configuration.

A particular embodiment of the display cabinet herein described comprises actuating servomechanisms for the movement elements 5. These movement elements 5 then become active movement elements, conceived to determine a displacement of the display cabinet on the resting surface 100. These servomechanisms comprise preferably electric motors, for example stepper motors.

The actuating servomechanisms of the movement elements 5 can be operated locally, with a user interface arranged on the body 2 of the display cabinet, and/or in a remote way by means of a remote-control device for example, wireless. This remote-control device can be a common cell phone provided with its own control software application.

The Applicant has finally noted that the environments wherein traditionally are arranged the hydrosanitary devices 10 and/or associated products are either enlightened by a light source or provided with a window that brings natural light on the interior environment. For this reason, the Applicant has conceived a particular embodiment of the display cabinet for hydrosanitary devices 1 that is described below.

Such embodiment is characterized by the presence of at least one optical radiator element 6 configured to irradiate the hydrosanitary devices 10 and/or associated products with an optical radiation that preferably, and at least partially, is placed in the visible spectrum.

Preferably, the at least one optical radiator element 6 is configured to diffuse an optical radiation within a solid angle of preferential radiation, and preferably this solid angle can be operatively adaptable. The adaptation occurs by adjustment of the solid angle width or by orientation of a central axis of radiation in said solid angle.

Specific embodiments of said optical radiator element 6 are spotlights, pivotable with respect to a fastening point on the body 2, in particular on the first portion 2*f* or on the second portion 2*r*. These spotlights preferably have a low-power lighting source, for example LEDs.

The optical radiator element 6 can be remotely controlled, as other components of the display cabinet, in the ways that are expressed in the present description.

The display cabinet of hydrosanitary devices 1 in this case comprises at least one power supply source for said at least one optical radiator element 6.

The power supply source is arranged within said body 2.

Alternatively, or in combination with the above, the display cabinet of hydrosanitary devices 1 is provided with a connector to allow to supply said optical radiator element 6 by means of a power supply source external with respect to said body 2.

It is noted, finally, that although in the previous portion of the description reference has been made to a direct fastening of the hydrosanitary device 10 and/or associated product to the body 2 (first portion 2*f*, or second portion 2*r*), this particular type of fastening is not to be intended as limiting.

In an embodiment, in fact, the display cabinet of hydrosanitary devices 1 object of the present disclosure comprises retention elements configured to realize a removable connection between a supporting surface 20 of the body 2, in particular of the first portion 2*f* of the body 2 and/or of the second portion 2*r* of the body 2, and a hydrosanitary device 10 and/or associated product.

Reference should be made to FIGS. 10-15. FIG. 10 shows a front view of a supporting surface 20 of the body 2 of the display cabinet object of the present disclosure, where it is present a plurality of hydrosanitary devices, in this case representing water supply and flow and temperature control elements for a domestic bathroom.

The hydrosanitary devices and/or associated products are retained on this supporting surface 20, in this case preferably vertical, by means of retention elements.

These retention elements are configured to allow a user to configure and repeatedly re-configure for a plurality of times, the position of the hydrosanitary device 10 and/or associated product with respect to the above-mentioned supporting surface of the body 2.

The retention elements comprise a first retention element 14 configured and destined to be directly engaged, and optionally irremovably engaged, to a hydrosanitary device 10 and/or associated product.

At least one front surface of the supporting surface 20 of the body 2 is specifically destined to enter directly in contact with at least one part, in particular a rear part of the first retention element 14.

Preferably, but non-limiting thereto, the retention elements comprise also a second retention element 111 which is connected, optionally irremovably connected, with at least part of the supporting surface 20 of the body 2; it is also possible that this second retention element 111 is integral with the, or part of the, supporting surface of the body 2.

The second retention element 111 is destined to directly interact with the hydrosanitary device 10 and/or associated product or, alternatively, is destined to directly interact with the first retention element 14. These two alternatives allow to realize the above-mentioned removable connection.

As schematically represented in FIG. 11, in an embodiment the first retention element 14 and/or the second retention element 111 comprise at least one magnetic or magnetically attractable connector, and thanks to this technical feature, the reconfigurability of the position and/or spatial orientation of the hydrosanitary device 10 and/or associated product is particularly made easy and effective at the same time.

As schematically represented in FIG. 12, in an embodiment, the supporting surface 20 of the body 2 comprises a plurality of second retention elements 111; this feature is not to be intended in a limiting way since in an alternative embodiment the supporting surface comprises a single second retention element that extends almost on the whole supporting surface itself. In FIG. 12 is represented a specific embodiment of second retention elements 111 in the form of a hook.

If a plurality of second retention elements 111 is present, these second retention elements are preferably arranged along a predefined and/or constant pattern or spatial configuration with respect to the supporting surface. For example, the plurality of second retention elements 111 can comprise equally spaced or otherwise reciprocally spaced second retention elements.

On the supporting surface can be present marking elements 30 arranged in correspondence of specific positions on the supporting surface. These marking elements can be visually detectable. In FIG. 13 is shown a particular embodiment of the marking elements 30. A rear portion 30*f* of the marking elements 30 is such to keep a front face of a double-layered supporting surface 20 in direct contact with the hydrosanitary device 10 and/or associated product.

The marking elements realize a visual aid pattern that facilitates the arrangement of one or more hydrosanitary devices 10 and/or associated product on the first portion 2*f* or on the second portion 2*r* of the body 2.

In a non-limiting embodiment, these marking elements comprise, or are, at least part of the second retention elements 111. Alternatively, these marking elements can differ with respect to the second retention elements or can be physically distinct with respect to the second retention elements 111.

In an embodiment, the retention elements are configured to realize a bayonet connection, in particular of the removable type. This connection occurs between the supporting surface and the hydrosanitary device 10 and/or associated product. This configuration is schematically presented in FIG. 14 and in FIG. 15.

The retention elements herein described can also comprise a slotted through-hole 20*f*, performed on the supporting surface of the body 2.

The slotted through-hole 20*f* is destined to be coupled in use with a retention pin 10*p* arranged in correspondence of a portion of the hydrosanitary device 10 and/or associated product. Preferably, but non-limiting thereto, this portion is a rear portion and/or is a not visible portion. Thanks to this technical feature the aesthetic appearance of the hydrosanitary device 10 and/or associated product is not altered, and this allows to not significantly alter the environment simulation created by the display cabinet object of the disclosure. Alternatively, the retention elements comprise at least one retention pin 10*p* arranged on the supporting surface and that, optionally, protrudes at least partially linearly from the supporting surface.

The retention pin 10*p* can be configured to be coupled in use with a through-hole drilled on a portion, for example and non-limiting thereto, a rear portion, of the hydrosanitary device 10 and/or associated product. The rear portion is anyway a non-visible portion of the hydrosanitary device 10 during the normal use.

Even alternatively, the retention elements can comprise a retention pin 10*p* arranged on the supporting surface and that optionally protrudes from a front face of the supporting surface. The retention pin 10*p* is configured to couple, in use, with a through-hole realized on a compensating element 10*t* arranged between the supporting surface and the hydrosanitary device 10 and/or associated product and configured to compensate a distortion or inclination or local deformation of the supporting surface.

The compensation takes place by a determined angle $\alpha$ configured to compensate an inclination or deformation angle $\beta$ locally assumed by the supporting surface due to a weight or leverage effect locally exerted by the hydrosanitary device 10 and/or associated product on the supporting surface of the body 2.

Still alternatively, it can be realized the opposed situation, wherein the retention elements comprise a through-hole drilled on the supporting surface, and within which in use is inserted a retention pin arranged on a surface in use not visible—for example a rear surface—of a compensating element arranged between the supporting surface and the hydrosanitary device and whose effect is the one above-described. The previously described opened configuration and closed configuration are operative configurations; in particular the opened configuration is a configuration which is used when the hydrosanitary devices and/or related accessories are exhibited to the user. For these purposes the opened configuration can be considered a condition of use or a condition of exhibition.

A further embodiment of the display cabinet herein described is characterized instead in that the opened configuration is a non-operative or non-use configuration. The display cabinet herein described in this case assumes a substantially movable showcase form, and the hydrosanitary devices and/or related accessories are visible through the lateral walls of the display cabinet itself, that thus in this case are substantially at least partially transparent to allow the view of the hydrosanitary devices and/or related accessories from outside.

Clearly, although in the shape of a showcase, the display cabinet according to this embodiment is provided with a first portion 2*f* and a second portion 2*r* movable to allow the opening for the purpose of at least installing or removing the hydrosanitary device 10 and/or related accessory.

In the opened configuration the body 2 can be disassembled, i.e., the first portion 2*f* and the second portion 2*r* can be completely disconnected from each other.

The opened configuration is in particular a configuration which is used to install the hydrosanitary device 10 and/or related accessory in the body 2, or to remove the hydrosanitary device 10 and/or related accessory from the body 2.

This embodiment presents thus:

- an opened configuration of said body 2, wherein said at least one hydrosanitary device 10 and/or associated product results visible and/or accessible from outside the body 2, and
- a closed configuration of said body 2, alternative to the opened configuration, wherein said at least one first hydrosanitary device 10 and/or associated product results enclosed inside of said body 2 and at least visible, from outside the body 2.

In this embodiment, optionally, in the closed configuration of the body 2, the at least one first hydrosanitary device 10 and/or associated product results inaccessible from outside the body 2.

It is noted finally that in the present description, where reference is made to a possibility of remote control or by means of remote-control device, this remote control and/or this remote controller can be conveniently carried out by means of, and/or be a virtual assistant.

A personal virtual assistant comprises a software which interprets the natural language and by means of commands given by a user can determine the activation of one or more of the servo-actuation functions described in the present description.

Optionally, this virtual assistant can be provided with the ability to dialogue with the user. In other words, said virtual assistant can be a vocal assistant. In view of the preceding description, it appears clear that the present disclosure refers further to a method for containing, transporting and/or displaying hydrosanitary devices and/or associated products 1 comprising at least the steps of:

- arranging a display cabinet according to the present disclosure;
- housing and/or fixing at least one first hydrosanitary device 10 and/or associated product, it at least one predefined position and/or spatial orientation into the body 2 of the display cabinet.

The method herein described comprises displaying at least said first hydrosanitary device 10 and/or associated product, housed in the body 2 of the display cabinet, in an exhibition environment.

The method herein described in addition comprises further at least one of the following steps:

closing at least said first hydrosanitary device 10 and/or associated product into said body 2 by means of a relative motion of closure of the first portion 2*f* with respect to the second portion 2*r;* transporting, towards or into the exhibition environment, the display cabinet here described, preferably already containing a hydrosanitary device 10 and/or associated product; and/or opening the body 2 by means of a relative motion of aperture of said first portion 2*f* with respect to said second portion 2*r*.

The invention is not limited to the embodiments shown in the figures; for this reason reference numbers and signs in the claims shall not be intended as limiting; they are provided for the sole purpose of increasing the intelligibility of the claims.

It is finally clear that to the object of the present disclosure can be applied modifications, additions or variants obvious for an expert in the art without exiting from the scope provided by the attached claims.

The invention claimed is:

1. Display cabinet of hydrosanitary devices or associated products or a combination thereof, configured to contain and keep at least one first hydrosanitary device or associated product or a combination thereof, in at least one first predefined position or spatial orientation or a combination thereof and comprising: a body having at least one first portion and one second portion movable one with respect to the other to define at least:

an opened configuration of said body, wherein said at least one first hydrosanitary device or associated products or a combination thereof is visible or accessible from outside the body, and a closed configuration of said body, alternative to the opened configuration, wherein said at least one first hydrosanitary device or associated products or a combination thereof is enclosed inside said body or not visible, or inaccessible, from outside the body;

said display cabinet being transportable along with said at least one first hydrosanitary device or associated products or a combination thereof and being stably positionable on a resting surface in an exhibition environment;

said display cabinet being configured to allow a user to configure and repeatedly reconfigure for a plurality of times, the position of the hydrosanitary device or associated products or a combination thereof with respect to the said supporting surface of the body.

2. Display cabinet of hydrosanitary devices and/or associated products according to claim 1, configured to contain and keep at least one first hydrosanitary device or associated, in at least one first predefined position or spatial orientation on, or with respect to, at least one supporting surface positioned within said body, or in at least one between said first portion and said second portion;

wherein at least one between said first portion and said second portion, is rigid or self-supporting, said display cabinet being a movable display cabinet and being movable in a plurality of positions, wherein said display cabinet is movable in a plurality of positions at least when said body is in said opened configuration or when said body is in said closed configuration;

wherein each position of said plurality of positions is a position stable on said resting surface;

wherein at least one between said first portion and said second portion is configured to house said at least one first hydrosanitary device or associated or a combination thereof in said at least one first predefined position or spatial orientation, wherein at least one between said first portion and said second portion is configured to house said at least one first hydrosanitary device or associated in said at least one first predefined position or spatial orientation and in at least one second predefined position or spatial orientation, wherein said first predefined position or spatial orientation or said second predefined position or spatial orientation is a position or spatial orientation relative with respect to said body or to at least one between said first portion and said second portion;

wherein when in said first predefined position or spatial orientation and when in said second predefined position or spatial orientation said at least one first hydrosanitary device or associated or a combination thereof lies in a position fixed with respect to at least part of the body, in particular with respect to at least one between the first portion and the second portion or wherein said first predefined position or spatial orientation is kept unaltered during a movement of at least one between said first portion and said second portion with respect to said resting surface;

or wherein a passage from said first predefined position or spatial orientation to said second predefined position or spatial orientation occurs by a temporary disconnection of said at least one first hydrosanitary device or associated or a combination thereof from said body, in particular from said first portion and said second portion.

3. Display cabinet according to claim 1, wherein at least one between said first portion and said second portion is configured to house, simultaneously, said at least one first hydrosanitary device or associated or a combination thereof and a second hydrosanitary device or associated or a combination thereof;

and wherein an upper part of said body has a curved or rounded shape defining an overall "trunk" shape for said body, or wherein at least one between said first portion and said second portion comprises a movement handle arranged on a vertical surface of said first portion or of said second portion, or wherein said body has a plurality of opened configurations, wherein in each opened configuration of said plurality of opened configurations, said first portion and said second portion have different angles of reciprocal rotation, and wherein in at least part of said plurality of opened configurations, or in all of the opened configurations of said plurality of opened configurations, said at least one first hydrosanitary device or associated is visible or accessible;

and wherein when said body is in said closed configuration, the first portion and the second portion are rigidly and constrained to each other, and wherein when said body is in said opened configuration, said first portion and said second portion are connected to each other;

wherein said at least one first hydrosanitary device or associated or a combination thereof is arranged in said first portion or alternatively in said second portion; the second portion being free to move with respect to the first portion without removal of the arrangement, or of the fastening of the at least one first hydrosanitary device or associated from the respective first portion or second portion.

4. Display cabinet according to claim 1, wherein when said body is in said closed configuration, said first portion is a front portion or left portion and said second portion is a rear portion or right portion, and wherein when said body is in said opened configuration, said first portion is a left portion and said second portion is a right portion, and wherein said first portion and said second portion are rotating one with respect to the other;

or wherein said first portion and said second portion are rotating one with respect to the other on an axis orthogonal to said resting surface;

said display cabinet comprising at least one first hinge configured to allow a rotation of said first portion with respect to said second portion around an axis substantially inclined with respect to said resting surface of said display cabinet of hydrosanitary devices or associated products;

said resting surface being a floor, or ground or said display cabinet being a floor display cabinet;

wherein each of said first portion and said second portion comprises a respective peripheral or perimeter area, wherein said at least one first hinge is arranged in correspondence of the peripheral or perimeter area of at least one between said first portion and said second portion;

or wherein when said body is in said opened configuration, said first portion and said second portion are aligned along a same plane.

5. Display cabinet according to claim 1, wherein said at least one between said first portion and said second portion, or both said first portion and said second portion, comprises a plurality of compartments or modules to house one or more hydrosanitary devices or associated products or a combination thereof, said compartments or modules comprising at least one among supporting planes, walls oblique with respect to said resting surface, drawers or internal doors; a position of at least one compartment or module of said plurality of compartments or modules being reconfigurable spatially in the respective position into the volume overall defined in said body, by the first portion or the second portion;

at least one between said first portion and said second portion, has a main development direction which is vertical or orthogonal with respect to said resting surface, or wherein said display cabinet is configured and specifically destined to support or arrange, when arranged on said resting surface, said at least one first hydrosanitary device or associated at a height, measured with respect to said resting surface, equal to a height at which said at least one first hydrosanitary device or associated or a combination thereof would be arranged in an effective or own operative installation.

6. Display cabinet according to claim 1, wherein at least one between said first portion and said second portion defines an environment closed on at least three sides or closed on five sides.

7. Display cabinet according to claim 6, wherein said first portion and said second portion define an environment opened on a respective accessing plane, and wherein when the body is in said closed configuration, said accessing plane of said first portion is coupled and coinciding with the accessing plane of said second portion and the assembly formed by the first portion and by the second portion defines as a whole an environment closed on six orthogonal sides, wherein at least one between said first portion and said second portion comprises a wall visible when said body is in said opened configuration, said wall being decorable with or providable with, or decorated with or provided with, an element comprising a color, a color pattern or shapes or an accessory, or an electronic device for representation of time-varying images simulating a real environment wherein said at least one first hydrosanitary device or associated or a combination thereof would be installed in a real configuration.

8. Display cabinet according to claim 1, wherein at least one between said first portion and said second portion comprises at least one first movement element, in use in direct contact with the resting surface and movably constrained, to a lower portion, in particular a base portion, of said at least one between said first portion and said second portion, wherein the at least one first movement element is configured to facilitate at least one between a rotation or translation of said body, in particular of at least one between said first portion and said second portion, on said resting surface;

wherein at least one between said first portion and said second portion, or each of said first portion and said second portion, comprises at least two movement elements, and comprises at least three or four movement elements configured and arranged for stably sustaining, or allowing the motion of, each of said first portion and second portion;

and wherein said at least one first movement element comprises at least one between a wheel, a roller, a track, a movable belt, a low friction coefficient sliding skid;

said at least one first movement element pivoting around an axis inclined with respect to said resting surface.

9. Display cabinet according to claim 8, wherein said at least one first movement element is active and is configured to determine a movement of said body on said resting surface;

said display cabinet comprising at least one movement servo-actuator for said at least one first movement element, and comprising at least one user interface placed in substantial correspondence of said body and configured to control said movement servo-actuator, or comprising a remote control interface configured to allow a control of said movement servo-actuator by a remote control device.

10. Display cabinet according to claim 1, comprising at least one optical radiator element configured to irradiate said at least one first hydrosanitary device or associated or a combination thereof with an optical radiation;

said at least one optical radiator element being configured to diffuse an optical radiation within a solid angle of preferential radiation, said solid angle being operatively adaptable, or said display cabinet of hydrosanitary devices/or associated or a combination thereof comprising at least one power supply source for said at least one optical radiator element and arranged within said body or comprising at least one connector for allowing to supply said optical radiator element by a power supply source external with respect to said body.

11. Display cabinet according to claim 1, wherein said at least one first hydrosanitary device or associated or a combination thereof is a faucet a faucet for sink, or for bidet, or for bathtub or for shower, or an electronic faucet, or a mechanically, not electronically, regulated faucet, or is a showerhead, or is a flexible shower, or is a aerator dispenser, or is a wall spout mouth, or is a toilet bowl, or is a shower tray, or is a bathtub, or is a bidet, or is a kitchen or bathroom sink, or is a hanging sink, or is a floor sink, or is a built-in sink, or is a heated towel rack, or is a toilet paper holder, or is a toilet bowl brush holder, or is a soap holder, or is a sponge holder or is a bathrobe, or a towel, or a bath slipper, or a bath cap, or a bath mat; said hydrosanitary device or associated being a device destined to the hygiene of the human being.

12. Display cabinet according to claim 1, comprising at least one servo-actuator configured to facilitate or determine a relative movement between said first portion and said second portion or to allow a switching between said opened configuration and said closed configuration of said body, said servo-actuator being controlled by a command arranged on said body or removably connectable to said body or being controlled by a remote command, of wireless type;

or comprising at least one speaker for playing back sounds, arranged within at least one between said first portion and said second portion.

13. Display cabinet according to claim 1, wherein at least one between said first portion and said second portion detects a defined shape or a defined volume; or wherein at least one between said first portion and said second portion comprises movable elements, extensible, configured to modify at least one between a volume or external shape thereof between a first volume or external shape and a second volume or external shape.

14. Display cabinet according to claim 1, wherein said at least one supporting surface is movable for allowing to orient or translate said at least one first hydrosanitary device or associated or a combination thereof in a plurality of positions, said supporting surface being movable manually or by a servo-actuator.

15. Display cabinet of hydrosanitary devices or associated products or a combination thereof, configured to contain and keep at least one first hydrosanitary device or associated or a combination thereof, in at least one first predefined position or spatial orientation and comprising: a body having at least one first portion and a second portion movable to define at least:

an opened configuration of said body, wherein said at least one hydrosanitary device or associated or a combination thereof is visible or accessible from outside the body, and a closed configuration of said body, alternative to the opened configuration, wherein said at least one first hydrosanitary device or associated or a combination thereof is enclosed inside said body and visible, and inaccessible, from outside the body;

said display cabinet being transportable along with said at least one first hydrosanitary device or associated or a combination thereof and being stably positionable on a resting surface in an exhibition environment;

wherein said opened configuration is a non-operative configuration or an installation or removal configuration of said at least one first device or associated respectively within or from said body.

16. Display cabinet according to claim 15, wherein when said body is in said closed configuration, said at least one first hydrosanitary device or associated or a combination thereof is inaccessible from outside the body, or wherein when said body is in said opened configuration, said first portion and said second portion are disconnected, and wherein said opened configuration is a configuration wherein said body is disassembled.

17. Method for containing, transporting or displaying hydrosanitary devices or associated products or a combination thereof comprising at least:

arranging a display cabinet according to claim 1;

housing or fixing at least one first hydrosanitary device or associated or a combination thereof, in at least a first predefined position or spatial orientation inside the body of said display cabinet; and displaying at least said first hydrosanitary device or associated or a combination thereof arranged in said body of said display cabinet, in an exhibition environment.

18. Method according to claim 17, further comprising:

closing at least said first hydrosanitary device or associated or a combination thereof into the body by a relative motion of closure of said first portion with respect to said second portion;

transporting, towards or into an exhibition environment, said display cabinet containing said first hydrosanitary device or associated or a combination thereof; or opening said body, containing at least said first hydrosanitary device or associated or a combination thereof, by a relative motion of opening of said first portion with respect to said second portion.

* * * * *